US010030451B1

(12) United States Patent
Mukhopadhyay et al.

(10) Patent No.: US 10,030,451 B1
(45) Date of Patent: Jul. 24, 2018

(54) POLYCRYSTALLINE DIAMOND COMPACTS INCLUDING A CEMENTED CARBIDE SUBSTRATE AND APPLICATIONS THEREFOR

(71) Applicant: US Synthetic Corporation, Orem, UT (US)

(72) Inventors: Debkumar Mukhopadhyay, Sandy, UT (US); Greg Carlos Topham, Spanish Fork, UT (US); Renato Ventura, Provo, UT (US)

(73) Assignee: US SYNTHETIC CORPORATION, Orem, UT (US)

( * ) Notice: Subject to any disclaimer, the term of this patent is extended or adjusted under 35 U.S.C. 154(b) by 636 days.

(21) Appl. No.: 14/539,015

(22) Filed: Nov. 12, 2014

(51) Int. Cl.

| | |
|---|---|
| ***B24D 3/02*** | (2006.01) |
| ***C09C 1/68*** | (2006.01) |
| ***C09K 3/14*** | (2006.01) |
| ***E21B 10/567*** | (2006.01) |
| ***B24D 3/06*** | (2006.01) |
| ***B24D 18/00*** | (2006.01) |

(52) U.S. Cl.
CPC ..... *E21B 10/567* (2013.01); *B24D 3/06* (2013.01); *B24D 18/0009* (2013.01)

(58) Field of Classification Search
None
See application file for complete search history.

(56) References Cited

U.S. PATENT DOCUMENTS 4,268,276 A 5/1981 Bovenkerk
4,311,490 A * 1/1982 Bovenkerk ..... B01J 3/062 51/307
4,410,054 A 10/1983 Nagel et al.
4,468,138 A 8/1984 Nagel
4,560,014 A 12/1985 Geczy
4,604,106 A 8/1986 Hall et al.
4,738,322 A 4/1988 Hall et al.
(Continued)

OTHER PUBLICATIONS

Final Office Action for U.S. Appl. No. 13/954,545 dated Jan. 10, 2017.
Issue Notification received for U.S. Appl. No. 13/590,840 dated Mar. 30, 2016.
Non-Final Office Action received for U.S. Appl. No. 13/954,545 dated Aug. 12, 2016.
Notice of Allowance received for U.S. Appl. No. 13/590,840 dated Dec. 16, 2015.
(Continued)

*Primary Examiner* — Colleen P Dunn
*Assistant Examiner* — Ross J Christie
(74) *Attorney, Agent, or Firm* — Dorsey & Whitney LLP

(57) ABSTRACT

Embodiments relate to a polycrystalline diamond compact ("PDC") including a polycrystalline diamond ("PCD") table having at least two regions and being bonded to a fine grained cemented tungsten carbide substrate. In an embodiment, a PDC includes a cemented carbide substrate having a cobalt-containing cementing constituent cementing tungsten carbide grains together that exhibit an average grain size of about 1.5 μm or less, and a PCD table having at least one upper region including diamond grains exhibiting an upper average grain size and at least one lower region adjacent to the upper region a lower average grain size that may be at least two times greater than the upper average grain size. The cemented carbide substrate includes an interfacial surface and a depletion zone depleted of the cementing constituent that extends inwardly from the interfacial surface to a depth of, for example, about 30 μm to about 60 μm.

22 Claims, 13 Drawing Sheets

(56) References Cited

U.S. PATENT DOCUMENTS

| | | | | |
|---|---|---|---|---|
| 4,811,801 | A | 3/1989 | Salesky et al. | |
| 4,913,247 | A | 4/1990 | Jones | |
| 5,016,718 | A | 5/1991 | Tandberg | |
| 5,092,687 | A | 3/1992 | Hall | |
| 5,120,327 | A | 6/1992 | Dennis | |
| 5,135,061 | A | 8/1992 | Newton, Jr. | |
| 5,154,245 | A | 10/1992 | Waldenstrom et al. | |
| 5,180,022 | A | 1/1993 | Brady | |
| 5,364,192 | A | 11/1994 | Damm et al. | |
| 5,368,398 | A | 11/1994 | Damm et al. | |
| 5,460,233 | A | 10/1995 | Meany et al. | |
| 5,480,233 | A | 1/1996 | Cunningham | |
| 5,544,713 | A | 8/1996 | Dennis | |
| 6,338,754 | B1 | 1/2002 | Cannon et al. | |
| 6,793,681 | B1 | 9/2004 | Pope et al. | |
| 7,866,418 | B2 | 1/2011 | Bertagnolli et al. | |
| 8,236,074 | B1 | 8/2012 | Bertagnolli et al. | |
| 8,297,382 | B2 | 10/2012 | Bertagnolli et al. | |
| 8,734,552 | B1 | 5/2014 | Vail et al. | |
| 9,316,059 | B1 | 4/2016 | Topham et al. | |
| 2004/0140132 | A1* | 7/2004 | Middlemiss | C04B 35/52 175/428 |
| 2005/0210755 | A1 | 9/2005 | Cho et al. | |
| 2006/0191723 | A1 | 8/2006 | Keshavan | |
| 2010/0022424 | A1 | 1/2010 | Vogt et al. | |
| 2010/0126779 | A1* | 5/2010 | Corbett | B22F 7/06 175/432 |
| 2010/0200305 | A1 | 8/2010 | Griffin et al. | |
| 2010/0212971 | A1* | 8/2010 | Mukhopadhyay | C22C 26/00 175/428 |
| 2011/0031033 | A1 | 2/2011 | Mourik et al. | |
| 2011/0067929 | A1* | 3/2011 | Mukhopadhyay | B01J 3/062 51/307 |
| 2012/0031675 | A1* | 2/2012 | Truemner | B01J 3/062 51/309 |
| 2012/0241226 | A1* | 9/2012 | Bertagnolli | C22C 26/00 51/309 |

OTHER PUBLICATIONS

Restriction Requirement received for U.S. Appl. No. 13/954,545 dated Apr. 7, 2016.
U.S. Appl. No. 15/078,904, filed Mar. 23, 2016.
Mukhopadhyay, et al., U.S. Appl. No. 14/539,015, filed Nov. 12, 2014.
U.S. Appl. No. 13/590,840, Nov. 4, 2014, Office Action.
U.S. Appl. No. 13/590,840, Feb. 3, 2015, Office Action.
U.S. Appl. No. 13/590,840, Jun. 23, 2015, Office Action.
U.S. Appl. No. 13/590,840, Sep. 11, 2015, Office Action.
U.S. Appl. No. 12/185,457, filed Aug. 4, 2008, Vail, et al.
U.S. Appl. No. 13/324,237, filed Dec. 13, 2011, Kdd et al.
U.S. Appl. No. 13/590,840, filed Aug. 21, 2012, Topham et al.
U.S. Appl. No. 61/727,841, filed Nov. 19, 2012, Mukhopadhyay.
U.S. Appl. No. 61/768,812, filed Feb. 25, 2013, Mukhopadhyay.
U.S. Appl. No. 13/795,027, filed Mar. 12, 2013, Mukhopadhyay et al.
U.S. Appl. No. 13/954,545, filed Jul. 30, 2012, Mukhopadhyay.
U.S. Appl. No. 14/081,960, filed Nov. 15, 2013, Mukhopadhyay.
ASTM B887-03 (2008) "Standard Test Method for Determination of Coercivity (Hcs) of Cemented Carbides".
ASTM B886-03 (2008), "Standard Test Method for Determination of Magnetic Saturation (Ms) of Cemented Carbides".
Rousse, G., et al., "Structure of the Intermediate Phase of PbTe at High Pressure," Physical Review B: Condensed Matter and Materials Physics, 71, 224116 (2005).
Decker, D. L., "High-Pressure Calibration: A Critical Review," J. Phys. Chem. Ref. Data, 1, 3 (1972).
Notice of Allowance received for U.S. Appl. No. 13/954,545 dated Apr. 13, 2017.
Issue Notification for U.S. Appl. No. 13/954,545 dated Jul. 26, 2017.
Non-Final Office Action for U.S. Appl. No. 15/078,904 dated Jul. 26, 2017.
Notice of Allowance for U.S. Appl. No. 15/078,904 dated Dec. 6, 2017.

* cited by examiner

POLYCRYSTALLINE DIAMOND COMPACTS INCLUDING A CEMENTED CARBIDE SUBSTRATE AND APPLICATIONS THEREFOR

BACKGROUND

Wear-resistant, polycrystalline diamond compacts ("PDCs") are utilized in a variety of mechanical applications. For example, PDCs are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller-cone drill bits and fixed-cutter drill bits. A PDC cutting element typically includes a superabrasive diamond layer commonly known as a diamond table. The diamond table is formed and bonded to a substrate using a high-pressure/high-temperature ("HPHT") process that sinters diamond particles under diamond-stable conditions. The PDC cutting element may also be brazed directly into a preformed pocket, socket, or other receptacle formed in a bit body. The substrate may optionally be brazed or otherwise joined to an attachment member, such as a cylindrical backing. A rotary drill bit typically includes a number of PDC cutting elements affixed to the bit body. It is also known that a stud carrying the PDC may be used as a PDC cutting element when mounted to a bit body of a rotary drill bit by press-fitting, brazing, or otherwise securing the stud into a receptacle formed in the bit body.

Conventional PDCs are normally fabricated by placing a cemented carbide substrate into a container with a volume of diamond particles positioned on a surface of the cemented carbide substrate. A number of such containers may be loaded into an HPHT press. The substrate(s) and volume of diamond particles are then processed under HPHT conditions in the presence of a catalyst material that causes the diamond particles to bond to one another to form a matrix of bonded diamond grains defining a polycrystalline diamond ("PCD") table. The catalyst material is often a metal-solvent catalyst (e.g., cobalt, nickel, iron, or alloys thereof) that is used for promoting intergrowth of the diamond particles.

In a conventional approach, a constituent of the cemented carbide substrate, such as cobalt from a cobalt-cemented tungsten carbide substrate, liquefies and sweeps from a region adjacent to the volume of diamond particles into interstitial regions between the diamond particles during the HPHT process. The cobalt acts as a catalyst to promote intergrowth between the diamond particles, which results in formation of a matrix of bonded diamond grains having diamond-to-diamond bonding therebetween, with interstitial regions between the bonded diamond grains being occupied by the solvent catalyst.

The presence of the metal-solvent catalyst in the PCD table is believed to reduce the thermal stability of the PCD table at elevated temperatures. For example, the difference in thermal expansion coefficient between the diamond grains and the metal-solvent catalyst is believed to lead to chipping or cracking of the PCD table during drilling or cutting operations, which can degrade the mechanical properties of the PCD table or cause failure. Additionally, some of the diamond grains can undergo a chemical breakdown or back-conversion to graphite via interaction with the solvent catalyst. At elevated high temperatures, portions of diamond grains may transform to carbon monoxide, carbon dioxide, graphite, or combinations thereof, thereby degrading the mechanical properties of the PDC.

One conventional approach for improving the thermal stability of a PDC is to at least partially remove the metal-solvent catalyst from the PCD table of the PDC by acid leaching. However, removing the metal-solvent catalyst from the PCD table can be relatively time consuming for high-volume manufacturing. Additionally, depleting the metal-solvent catalyst may decrease the mechanical strength of the PCD table.

SUMMARY

Embodiments of the invention relate to a PDC including a relatively fine average grain sized cemented tungsten carbide substrate bonded to a PCD table including at least one region or portion of diamond grains having a relatively coarse average grain size and at least another region or portion of diamond grains having a relatively fine average grain size that is positioned adjacent to an upper working surface of the PCD table. The PCD table structure may enhance at least one mechanical property of the PDC, such as at least one of abrasion resistance, thermal stability, or impact resistance. The disclosed cemented tungsten carbide substrate may mitigate related high residual tensile stresses to thereby provide for relatively more secure bonding of the PCD table to the cemented tungsten carbide substrate and one or more of enhanced wear resistance, corrosion resistance, enhanced braze cracking resistance, or enhanced erosion resistance, and a PDC with enhanced impact resistance.

In an embodiment, a PDC includes a cemented carbide substrate having a cobalt-containing cementing constituent cementing a plurality of tungsten carbide grains together that exhibit an average tungsten carbide grain size of about 1.5 μm or less (e.g., about 0.8 μm to about 1.5 μm). The cemented carbide substrate includes an interfacial surface and a depletion zone depleted of the cobalt-containing cementing constituent that extends inwardly from the interfacial surface to a depth. The PDC includes a PCD table bonded to the interfacial surface of the cemented carbide substrate. The PCD table includes at least one lower region including a plurality of diamond grains exhibiting a lower average grain size, and at least one upper region positioned adjacent to the at least one lower region and including a plurality of diamond grains exhibiting an upper average grain size. The lower average grain size of the at least one lower region may be at least two times greater than that of the upper average grain size of the at least one upper region.

In an embodiment, a method of fabricating a PDC is disclosed. The method includes enclosing a combination in a pressure transmitting medium to form a cell assembly. The combination includes a cemented carbide substrate including a cobalt-containing cementing constituent cementing a plurality of tungsten carbide grains together that exhibit an average tungsten carbide grain size of about 1.5 μm or less (e.g., about 0.8 μm to about 1.5 μm). The cemented carbide substrate further including an interfacial surface. The combination further includes at least one lower region having a plurality of diamond particles positioned at least proximate to the interfacial surface of the cemented carbide substrate, and at least one upper region including a plurality of diamond particles positioned adjacent to the at least one lower region. The plurality of diamond particles of the at least one lower region exhibits an average particle size that is at least two times greater than that of an average particle size of the plurality of diamond particles of the at least one upper region. The method further includes subjecting the cell assembly to an HPHT process effective to sinter the pluralities of diamond particles and integrally form a PCD table bonded to the interfacial surface of the cemented carbide substrate from the combination.

Other embodiments include applications utilizing the disclosed PDCs in various articles and apparatuses, such as rotary drill bits, bearing apparatuses, wire-drawing dies, machining equipment, and other articles and apparatuses.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical or similar elements or features in different views or embodiments shown in the drawings.

DETAILED DESCRIPTION

Embodiments of the invention relate to a PDC including a relatively fine average grain sized cemented tungsten carbide substrate bonded to a PCD table including at least one region of diamond grains having a relatively coarse average grain size and at least another region of diamond grains having a relatively fine average grain size that is positioned adjacent to an upper working surface of the PCD table. The PCD table structure may enhance at least one mechanical property of the PDC, such as at least one of abrasion resistance, thermal stability, or impact resistance. The disclosed cemented tungsten carbide substrate may mitigate related high residual tensile stresses to thereby provide for relatively more secure bonding of the PCD table to the cemented tungsten carbide substrate and one or more of enhanced wear resistance, corrosion resistance, enhanced braze cracking resistance, or enhanced erosion resistance, and a PDC with enhanced impact resistance.

The layering of coarse and fine diamond particle sizes that eventually form the PCD table may also limit infiltration into the fine average particle size region with infiltrant from the cemented carbide substrate during HPHT processing to enhance at least one of abrasion resistance, thermal stability, or impact resistance of the resulting PDC. The impact resistance of the disclosed PDCs is believed to be enhanced at least partially due to a relatively lower amount of cobalt depleted from a depletion zone and/or a more gradual depletion zone in the cemented carbide substrate compared to a standard PDC using a relatively coarse sized cemented tungsten carbide substrate. Such a configuration for the cemented carbide substrate may optionally exhibit a relatively higher Palmquist fracture toughness in the depletion zone. The inventors also currently believe that the relatively fine average grain size of the tungsten carbide grains in the cemented carbide substrate limits physical access to the cobalt-containing cementing constituent by diamond particles during HPHT sintering, thereby reducing or substantially reducing and/or eliminating abnormal grain growth of tungsten carbide grains at the interfacial surface of the cemented carbide substrate.

Figure 1A:
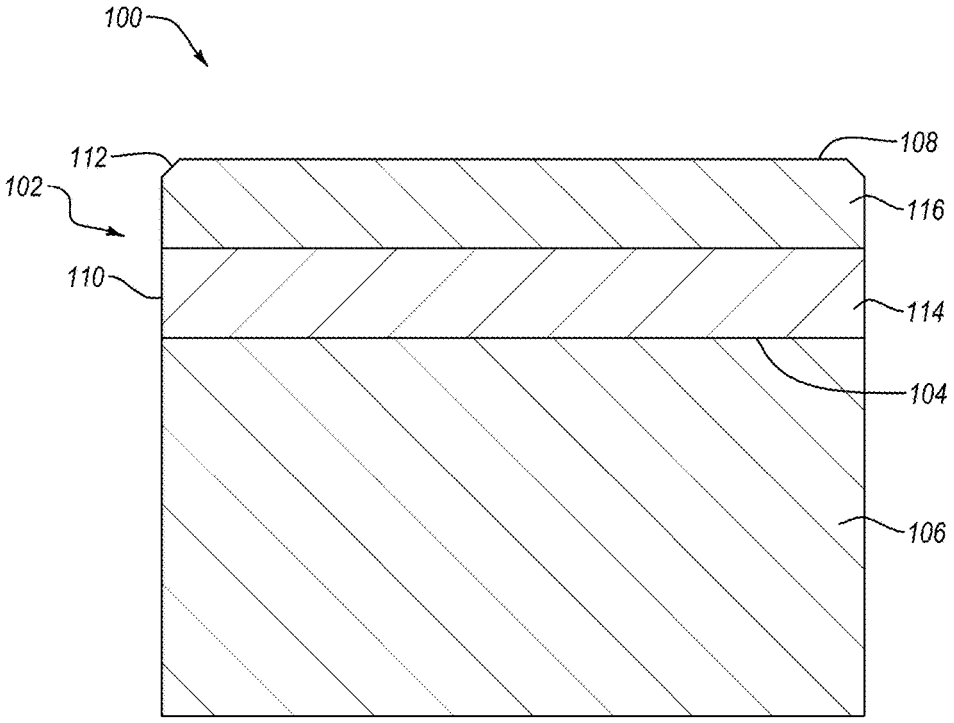
FIG. 1A a cross-sectional view of a PDC according to an embodiment.
Figure 1B:
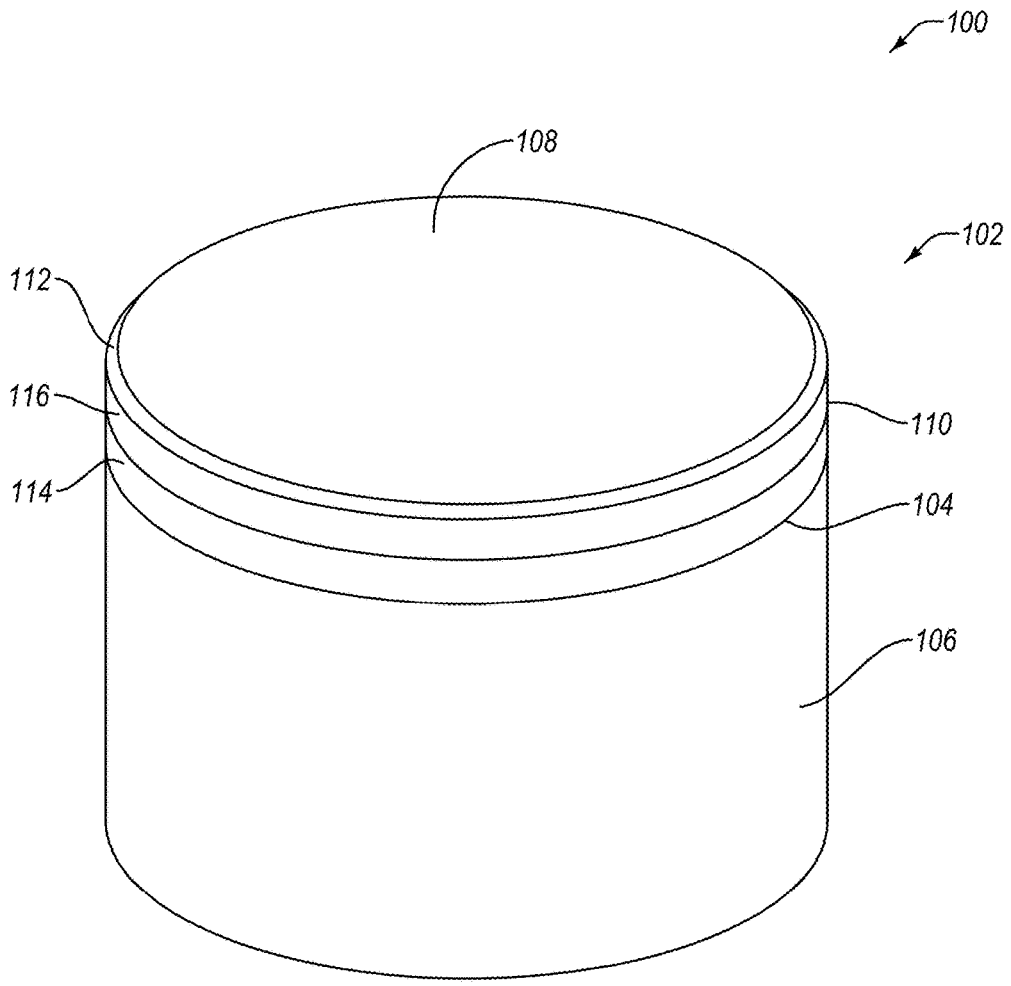
FIG. 1B is an isometric view of the PDC shown in FIG. 1A.

FIGS. 1A and 1B are isometric and cross-sectional views, respectively, of a PDC 100 according to an embodiment. The PDC 100 includes a cemented carbide substrate 106 including at least tungsten carbide grains cemented with a cobalt-containing cementing constituent. The cemented carbide substrate 106 may include relatively fine cemented tungsten carbide grains (e.g., about 1.5 μm or smaller). The cemented carbide substrate 106 includes an interfacial surface 104. In the illustrated embodiment, the interfacial surface 104 is substantially planar. However, in other embodiments, the interfacial surface 104 may exhibit a nonplanar topography.

The PDC 100 further includes a PCD table 102 bonded to the interfacial surface 104 of the cemented carbide substrate 106. The PCD table 102 includes an upper surface 108, at least one lateral surface 110, an optional chamfer 112 extending therebetween, and a plurality of directly bonded-together diamond grains exhibiting diamond-to-diamond bonding therebetween (e.g., $sp^3$ bonding). The PCD table 102 may include a bonding surface substantially opposite the upper surface 108 and having a complementary configuration (e.g., topography) to the interfacial surface 104. The plurality of directly bonded-together diamond grains defines a plurality of interstitial regions. Some or substantially all of the plurality of interstitial regions may be occupied by a metallic constituent, such as a metal-solvent catalyst or a metallic infiltrant, such as cobalt, iron, nickel, or alloys thereof. For example, the metallic constituent may comprise a portion of the cobalt-containing cementing constituent from the cemented carbide substrate 106. One or more of the upper surface 108, at least one lateral surface 110, or chamfer 112 may function as a working/cutting or bearing surface during use. Although FIGS. 1A and 1B show the PDC 100 has having a cylindrical geometry and the upper surface 108 and the interfacial surface 104 as being substantially planar, in other embodiments, the PDC 100 may exhibit a non-cylindrical geometry and/or the upper surface 108 and/or the interfacial surface 104 may be concave, convex, or another selected non-planar geometry.

The PCD table 102 further includes at least one lower region 114 (e.g., a portion, a layer, etc.) bonded to the interfacial surface 104 of the cemented carbide substrate 106, and at least one upper region 116 (e.g., a portion, a layer, etc.) positioned adjacent to and bonded to the lower region 114. The lower region 114 includes a lower average grain size that is relatively coarser than an upper average grain size of the upper region 116. The lower average grain size of the lower region 114 may be at least two times greater than that of the upper average grain size of the upper region 116. The upper average grain size may be over 20 μm, over 25 μm, or over 30 μm. As discussed above, the PDC 100 including such a layered PCD table 102 may exhibit at least one of enhanced abrasion resistance, thermal stability, or impact resistance and a relatively more secure bond of the PCD table 102 to the cemented carbide substrate 106.

In an embodiment, the PCD table 102 may be integrally formed with (i.e., formed from diamond powder sintered on) the cemented carbide substrate 106. In another embodiment, the PCD table 102 may be a preformed (i.e., a preformed PCD table) in a first HPHT process and subsequently bonded to the cemented carbide substrate 106 in a second HPHT bonding process.

As will be discussed in more detail below, in some embodiments, the metallic constituent disposed in at least a portion of the interstitial regions may be infiltrated primarily from the cemented carbide substrate 106. In other embodiments, the metallic constituent may be provided from another source, such as disc of metal-solvent catalyst and/or metallic infiltrant.

As previously discussed, the cemented carbide substrate 106 includes relatively fine tungsten carbide grains that may impart enhanced wear resistance and/or toughness to the cemented carbide substrate 106. The cemented carbide substrate 106 includes a cobalt-containing cementing constituent that cements a plurality of tungsten carbide grains together. For example, the cobalt-containing cementing constituent may be a cobalt alloy having tungsten and carbon dissolved therein from the tungsten carbide grains. The plurality of tungsten carbide grains exhibits an average grain size of about 2.5 μm or less, about 1.5 μm or less, about 1.4 μm or less, about 1.2 μm or less, about 0.5 μm to about 2.5 μm, 0.5 μm to about 2 μm, 0.8 μm to about 1.3 μm, 0.80 μm to about 1.5 μm, about 1.0 μm to about 1.5 μm, about 1.2 μm to about 1.4 μm, or about 1.2 μm. The cobalt-containing cementing constituent may be present in the cemented carbide substrate 106 in an amount of about 10 weight % to about 16 weight %, about 10 weight % to about 15 weight %, such as about 12 weight % to about 14 weight % or about 13 weight % in combination with any of the disclosed tungsten carbide average grain sizes.

The cemented carbide substrate may exhibit a transverse rupture strength of about 460 ksi to about 550 ksi (e.g., about 490 ksi to about 550 ksi, about 500 ksi to about 540 ksi, about 510 ksi to about 530 ksi about 515 ksi to about 540 ksi, or about 520 ksi to about 530 ksi) along with a hardness of about 89.0 HRa to about 92 HRa (e.g., about 89.5 HRa to about 92 HRa, about 90 HRa to about 92 HRa, or about 90.5 HRa). The cemented carbide substrate 106 may also exhibit a coercivity of about 130 Oe to about 250 Oe (e.g., about 140 Oe to about 220 Oe, about 160 Oe to about 220 Oe, or about 180 Oe to about 200 Oe) along with a magnetic saturation of about 85% to 95% (e.g., about 87 to about 95%) prior to HPHT processing. After HPHT processing when bonded to the PCD table 102 in the form of the PDC 100, the cemented carbide substrate 106 may exhibit a coercivity of about 130 Oe to about 150 Oe (e.g., about 135 Oe to about 145 Oe, or about 140 Oe) along with a magnetic saturation of about 10 $G \cdot cm^3/g$ to about 20 $G \cdot cm^3/g$, such as about 13 $G \cdot cm^3/g$ to about 16 $G \cdot cm^3/g$, or about 15.5 $G \cdot cm^3/g$.

In an embodiment, the cemented carbide substrate 106 includes about 13 weight % cobalt, with the balance substantially being tungsten carbide gains having an average grain size of about 1.4 μm or less such as about 1.2 μm, about 1.3 μm or less, or about 1.4 μm or less. In another embodiment, the cemented carbide substrate 106 includes about 12 weight % cobalt, with the balance substantially being tungsten carbide gains having an average grain size of about 2 μm or less, such as about 2 μm.

It should be noted that cemented carbide substrate 106 may also include other carbides in addition to tungsten carbide grains. For example, the cemented carbide substrate 106 may include chromium carbide grains, vanadium carbide, nickel carbide, tantalum carbide grains, tantalum carbide-tungsten carbide solid solution grains, or any combination thereof. Such additional carbides may be present in the cemented carbide substrate 106 in an amount ranging from about 0.05 weight % to about 10 weight %, such as 1 weight % to about 10 weight %, 1 weight % to about 3 weight %, about 0.050 weight % to about 0.50 weight %, about 0.050 weight % to about 0.15 weight %, about 0.050 weight % to about 0.10 weight %, about 0.50 weight % to about 1.00 weight %, or about 1.0 weight % to about 2.0 weight %, with the balance being any of the previously disclosed concentrations for the tungsten carbide grains and the cobalt-containing cementing constituent.

In some embodiments, the PCD table 102 may be fabricated using HPHT conditions in which a sintering cell pressure is at least about 7.5 GPa so that at least one region of the PCD table 102 so formed includes a relatively high amount of diamond-to-diamond bonding, a relatively small diamond grain size, and a relatively small amount of the metallic constituent (e.g., cobalt-containing cementing constituent) incorporated therein. For example, U.S. Pat. No. 7,866,418 discloses suitable high-pressure sintering techniques that may be combined with the cemented carbide substrates disclosed herein. U.S. Pat. No. 7,866,418 is incorporated herein, in its entirety, by this reference. When at least a region of the PCD table 102 is fabricated in such a manner, the very high wear resistance of the PCD table 102 may result in the cemented carbide substrate 106 prematurely preferentially wearing away or eroding away during use. It is currently believed by the inventors that the cemented carbide substrate 106 including the relatively fine tungsten carbide grain size, as discussed above, enhances the cemented carbide substrate's 106 wear resistance, erosion resistance, toughness, corrosion resistance, or combinations thereof.

As discussed above, the PCD table 102 includes a plurality of diamond grains directly bonded together via diamond-to-diamond bonding that defines a plurality of interstitial regions. At least a portion of the interstitial regions or, in some embodiments, substantially all of the interstitial regions of at least a region of the PCD table 102 may be occupied by the metal-solvent catalyst (e.g., the cobalt-containing cementing constituent) and/or a metallic infiltrant, such as iron, nickel, cobalt, or alloys of any of the foregoing metals.

The lower region 114 of the PCD table 102 includes a lower average grain size that is relatively coarser than an upper average grain size of the upper region 116 of the PCD table 102. The lower average grain size of the lower region 114 may be at least two times greater than that of the upper average grain size of the upper region 116. In an embodiment, the upper average grain size may be greater than 20 μm, greater than 25 μm, or greater than 30 μm. As discussed above, the PDC 100 including such a layered PCD table 102 may provide for enhancing at least one of abrasion resistance, thermal stability, or impact resistance and a relatively more secure bond of the PCD table 102 to the cemented carbide substrate 106.

Although the illustrated embodiment of the PCD table 102 shown in FIGS. 1A and 1B only utilizes two distinct regions of diamond grains, two or more, or more than three regions may be employed. In an embodiment, each region may have a progressively smaller average diamond grain size with distance away from the substrate 106. The inventors currently believe that this layered structure for the PCD table 102 of coarse average diamond grain size of the lower region 114 adjacent to the cemented carbide substrate 106 with progressively smaller average diamond grain sizes with distance away from the cemented carbide substrate 106 in the upper region 116, and optional additional regions may limit infiltrant from the cemented carbide substrate 106 (e.g., the cobalt-containing cementing constituent) from infiltrating into the regions closest to the upper surface 108 during fabrication, which may provide for at least one of increased abrasion resistance, thermal stability, or higher impact resistance of the PDC 100 so formed.

According to various embodiments, the coarse lower average grain size of the lower region 114 may be at least about 50 μm, at least about 60 μm, about 50 μm to about 75 μm, about 60 μm to about 80 μm, about 65 μm to about 75 μm, greater than about 70 μm, greater than about 60 μm, about 60 μm to about 75 μm, about 65 μm to about 85 μm, about 68 μm to about 72 μm, about 63 μm to about 78 μm, about 63 μm to about 67 μm, about 70 μm, at least about 2.0 times the upper average grain size, about 2.0 times the upper average grain size to about 3.5 times (e.g., about 2.5 to about 3.5) the upper average grain size, at least about 2.5 times the upper average grain size, at least about 3.5 times the upper average grain size. In various embodiments, the upper average grain size of the upper region 116 may be less than about 40 μm, about 20 μm to about 35 μm, less than about 30 μm, about 20 μm to about 40 μm, about 28 μm to about 32 μm, about 25 μm to about 35 μm, greater than 10 μm, greater than 20 μm, greater than 30 μm, greater than 35 μm, about 10 μm to about 40 μm, less than about 30 μm, less than about 35 μm, about 2 μm to about 10 μm, about 15 μm to about 35 μm, submicron grains sizes (e.g., 500 nm, 100 nm, 50 nm, 10 nm), about 2 μm, about 5 μm, about 10 μm, about 19 μm, or about 30 μm. Any combination of the lower and upper average grain sizes may be employed provided that the lower average grain size is at least about 2 times the upper average grain size.

In some embodiments, the diamond grains in a region may exhibit a single mode or single average grain size, a bimodal average grain size (i.e. a volume of diamond grains comprising two average grain sizes), or any multimodal average grain size (e.g., trimodal, quadmodal, etc.). For example, the upper region 116 may include more than one average grain size, such as by way of non-limiting example, a bimodal distribution of a first average grain size of about 20 μm to about 40 μm and a second average grain size of less than about 20 μm, a first average grain size of about 30 μm and a second average grain size of about 2 μm, a first average grain size of about 20 μm and a second average grain size of about 2 μm, or a first average grain size of any of the average grains sizes disclosed for the coarse lower region and a second average grain size of any of the average grain sizes disclosed for the coarse lower region, without limitation so long as the grain sizes differ. In some embodiments, the coarse lower region 114 may exhibit a single mode or single average grain size, a bimodal average grain size (i.e., a volume of diamond grains comprising two average grain sizes), or any multimodal average grain size (e.g., trimodal, quadmodal, etc.). In an embodiment, such as by way of non-limiting example, the coarse lower region 114 may exhibit a single mode having an average grain size of about 50 μm or greater, such as about 50 μm to about 55 μm, about 60 μm, about 65 μm, about 60 μm to about 65 μm, about 70 μm, about 75 μm, about 50 μm to about 60 μm, or about 60 μm to about 70 μm. In an embodiment, the course lower region 114 may include a bimodal distribution of a first average grain size of about at least about 50 μm to about 70 μm and a second average grain size of about 75 μm or more, or a first average grain size of any of the average grains sizes disclosed for the coarse lower region and a second average grain size of any of the average grain sizes disclosed for the coarse lower region so long as the grain sizes differ and the average grain size in the lower region is at least about 2 times the upper average grain size.

In an embodiment, the plurality of diamond grains in one or both of the upper region 116 or the lower region 114 may include a first amount or portion that is about 5 weight % to about 40 weight % of the plurality of diamond grains in the respective region, a second amount or portion that is about 60 weight % to about 95 weight % of the plurality of diamond grains in the respective region, and optionally, a third amount or portion that is about 5 weight % to about 30 weight % of the plurality of diamond grains in the respective region. In an embodiment, the plurality of diamond grains in one or both of the upper region 116 or the lower region 114 may include a first amount or portion that is about 5 weight % to about 30 weight % of the plurality of diamond grains in the respective region, a second amount or portion that is about 70 weight % to about 95 weight % of the plurality of diamond grains in the respective region, and optionally, a third amount or portion that is about 5 weight % to about 15 weight % of the plurality of diamond grains in the respective region. The first amount may exhibit a first average grain size identical to those described herein for the respective regions, the second amount may exhibit a second average grain size that is larger than the first average grain size and identical to those described herein for the respective regions, and, the optional third amount may exhibit a third average grain size that is larger than the first and second average grain sizes and identical to those described herein for the respective regions. The average diamond grain sizes of the lower region 114 and the upper region 116 may be the substantially the same, similar, or may vary from that of the precursor average diamond particle sizes from which they are formed. As sintered, diamond grain size may vary from precursor diamond particle size based on a number of factors including but not limited to, extent of diamond-to-diamond bond formation, nucleation and growth of diamond during HPHT sintering, and dissolution and deposition of $sp^3$ carbon on diamond particle surfaces during HPHT sintering.

In one or more embodiments, the lower region 114 includes diamond grains and may also include at least one additive that together defines the interstitial regions having the metal-solvent catalyst disposed in at least a portion of the interstitial regions. The at least one additive may be chosen from tungsten carbide particles, cemented tungsten carbide particles (e.g., individual particles formed of tungsten carbide particles cemented together with cobalt or a cobalt alloy), tungsten particles, or mixtures thereof. For example, the cemented tungsten carbide particles may be formed by sintering tungsten carbide particles with a binder (e.g., cobalt), crushing the sintered product into a plurality of particles, and classifying the crushed particles to a specific particle size range. The amount of the at least one additive present in lower region 114 may be about 1 weight % to about 20 weight % of the lower region 114, such as about 1 weight % to about 15 weight %, about 1 weight % to about 5 weight %, about 2 weight % to about 5 weight %, about 2 weight % to about 4 weight %, less than about 5 weight %, about 1 weight % to about 10 weight %, about 3 weight % to about 6 weight %, about 4 weight % to about 6 weight %, about 3 weight % to about 10 weight %, about 2 weight % to about 15 weight %, about 10 weight % to about 20 weight %, about 5 weight % to about 15 weight %, or about 10 weight % to about 15 weight % of the lower region 114, with the balance substantially being diamond grains and the metal-solvent catalyst. In an embodiment, the at least one additive may include both tungsten and tungsten carbide. For example, tungsten may be present in the lower region 114 in an amount of about 5 weight % or less of the lower region 114, such as about 1 weight % to about 5 weight %, about 2 weight % to about 4 weight %, about 1 weight % to about 3 weight %, or about 2 weight % to about 3 weight %; the tungsten carbide may be present in the lower region 114 in an amount of about 15 weight % or less of the lower region 114, such as about 5 weight % to about 15 weight %, about 9 weight % to about 12 weight %, about 10 weight % to about 15 weight %, or about 10 weight % to about 11 weight %; or combinations of any of the foregoing. In an embodiment, the at least one additive may include at least about 3 to about 6 times more tungsten carbide than tungsten, such as about 4 to about 5 times more tungsten carbide than tungsten, or about 4.5 to about 5.5 times more tungsten carbide than tungsten. In an embodiment, the at least one additive in the lower region 114 may include about 5 weight % to about 15 weight % of tungsten carbide and about 1 weight % to about 5 weight % of tungsten. In some embodiments, the at least one additive may include more than about 5 weight % of tungsten and more than about 15 weight % of tungsten carbide. In some embodiments, the upper region 116 may be substantially free of the at least one additive, while in other embodiments, a small amount of the at least one additive may migrate into the upper region 116 during formation thereof.

In one or more embodiments, the $G_{ratio}$ of the PCD table 102 of the PDC 100 may be about $1\times10^6$ to about $1.5\times10^7$, such as about $2\times10^6$ to about $4\times10^6$, about $1\times10^6$ to about $3.5\times10^6$, about $2.5\times10^6$ to about $3.0\times10^6$, about $4\times10^6$ to about $6.5\times10^6$, about $5\times10^6$ to about $7.5\times10^6$, at least about $2\times10^6$, or about $4\times10^6$. The $G_{ratio}$ may be evaluated using a vertical turret lathe ("VTL") test by measuring the volume of the PDC 100 removed versus the volume of workpiece removed, while the workpiece is cooled with water. The test parameters may include a depth of cut for the PDC 100 of about 0.254 mm, a back rake angle for the PDC 100 of about 20 degrees, an in-feed for the PDC 100 of about 6.35 mm/rev, a rotary speed of the workpiece to be cut of about 101 RPM, and a set number of passes (e.g., 50 or 100 passes) of the PDC 100 on the across the workpiece. The volume of the workpiece removed and the volume of the PDC 100 removed may be determined after the set number of passes (e.g., 50, 100, or 150 passes). The workpiece may be made from Bane granite, such as Barre granite having a 914 mm outer diameter and a 254 mm inner diameter.

In some embodiments, the metallic constituent (e.g., the cobalt-containing cementing constituent) that occupies at least a portion of the interstitial regions may be present in at least a region of the PCD table 102 in an amount of about 7.5 weight % or less. In some embodiments, the metallic constituent may be present in at least a region of the PCD table 102 in an amount of about 1 weight % to about 7.5 weight %, such as about 3 weight % to about 7.5 weight % or 3 weight % to about 6 weight %. These relatively low concentrations may be achieved by using the relatively high sintering cell pressures discussed above. In other embodiments, the metallic constituent content may be present in at least a region of the PCD table 102 in an amount less than about 3 weight %, such as about 1 weight % to about 3 weight % or a residual amount to about 1 weight %. By maintaining the metallic constituent content below about 7.5 weight %, at least a region of the PCD table 102 may exhibit a desirable level of thermal stability suitable for subterranean drilling applications. According to various embodiments, and as discussed in more detail below, the at least a region of the PCD table 102 sintered at a cell pressure of at least about 7.5 GPa may exhibit a coercivity of 115 Oe or more, a high-degree of diamond-to-diamond bonding, a specific magnetic saturation of about 15 $G\cdot cm^3/g$ or less, and a metallic constituent content of about 7.5 weight % or less.

Many physical characteristics of the PCD table 102 may be determined by measuring certain magnetic properties of at least a region of the PCD table 102 because the metal-solvent catalyst may be ferromagnetic. The amount of the metallic constituent present in at least a region of the PCD table 102 may be correlated with the measured specific magnetic saturation of the PCD table 102. A relatively larger specific magnetic saturation indicates relatively more metal-solvent catalyst in the region of the PCD table 102.

The mean free path between neighboring diamond grains of a region of the PCD table 102 may be correlated with the measured coercivity of the region of the PCD table 102. A relatively large coercivity indicates a relatively smaller mean free path. The mean free path is representative of the average distance between neighboring diamond grains of the region of the PCD table 102, and thus may be indicative of the extent of diamond-to-diamond bonding in the region of the PCD table 102. A relatively smaller mean free path, in well-sintered PCD table 102, may indicate relatively more diamond-to-diamond bonding.

As merely one example, ASTM B886-03 (2008) provides a suitable standard for measuring the specific magnetic saturation and ASTM B887-03 (2008) e1 provides a suitable standard for measuring the coercivity of the PCD. Although both ASTM B886-03 (2008) and ASTM B887-03 (2008) e1 are directed to standards for measuring magnetic properties of cemented carbide materials, either standard may be used to determine the magnetic properties of PCD. A KOERZIMAT CS 1.096 instrument (commercially available from Foerster Instruments of Pittsburgh, Pa.) is one suitable instrument that may be used to measure the specific magnetic saturation and the coercivity of the PCD. Magnetic properties of PCD tables including coercivity and magnetic saturation, and methods of making PCD tables exhibiting certain magnetic properties are discussed in more detail in U.S. Pat. No. 7,866,418.

Generally, as the sintering pressure that is used to form the PCD table 102 increases, the coercivity may increase and the magnetic saturation may decrease. The PCD table 102 or at least a region therein defined collectively by the bonded diamond grains and the metallic constituent may exhibit a coercivity of about 115 Oe or more and a metallic constituent content of less than about 7.5 weight % as indicated by a specific magnetic saturation of about 15 $G \cdot cm^3/g$ or less. In an embodiment, the coercivity of at least a region of the PCD table 102 may be about 115 Oe to about 250 Oe and the specific magnetic saturation of at least a region of the PCD may be greater than 0 $G \cdot cm^3/g$ to about 15 $G \cdot cm^3/g$. In an embodiment, the coercivity of at least a region of the PCD table 102 may be about 155 Oe to about 175 Oe and the specific magnetic saturation of the PCD may be greater than 0 $G \cdot cm^3/g$ to about 15 $G \cdot cm^3/g$. In an embodiment, the coercivity of at least a region of the PCD table 102 may be about 115 Oe to about 175 Oe and the specific magnetic saturation of at least a region of the PCD table 102 may be about 5 $G \cdot cm^3/g$ to about 15 $G \cdot cm^3/g$. In an embodiment, the coercivity of the at least a region of PCD table 102 may be about 155 Oe to about 175 Oe and the specific magnetic saturation of the PCD table 102 may be about 10 $G \cdot cm^3/g$ to about 15 $G \cdot cm^3/g$. In an embodiment, the coercivity of at least a region of the PCD table 102 may be about 130 Oe to about 160 Oe and the specific magnetic saturation of at least a region of the PCD table 102 may be about 10 $G \cdot cm^3/g$ to about 15 $G \cdot cm^3/g$. The specific permeability (i.e., the ratio of specific magnetic saturation to coercivity) of the PCD may be about 0.10 $G \cdot cm^3/g \cdot Oe$ or less, such as about 0.060 $G \cdot cm^3/g \cdot Oe$ to about 0.090 $G \cdot cm^3/g \cdot Oe$. In some embodiments, despite the average grain size of the bonded diamond grains in at least a region of the PCD table 102 being about 30 μm or less, the metallic constituent content in the PCD table 102 may be less than about 7.5 weight % (e.g., about 3 weight % to about 7.5 weight % or 3 weight % to about 6 weight %), resulting in a desirable thermal stability and the above mentioned magnetic properties.

Generally, as the sintering cell pressure is increased above 7.5 GPa, a wear resistance of the PCD table 102 so formed may increase. For example, in one or more embodiments, the $G_{ratio}$ of the PCD table 102 of the PDC 100 may be about $1\times10^6$ to about $1.5\times10^7$, such as about $2\times10^6$ to about $4\times10^6$, about $1\times10^6$ to about $3.5\times10^6$, about $2.5\times10^6$ to about $3.0\times10^6$, about $4\times10^6$ to about $6.5\times10^6$, about $5\times10^6$ to about $7.5\times10^6$, at least about $2\times10^6$, or about $4\times10^6$. In some embodiments, the $G_{ratio}$ may be at about $5.0\times10^6$ to about $15.0\times10^6$ or, more particularly, about $8.0\times10^6$ to about $15.0\times10^6$ or at least about $30.0\times10^6$. The $G_{ratio}$ may be evaluated using a VTL test as described above.

PCD formed by sintering diamond particles having the same diamond particle regions and/or size distribution(s) as a PCD embodiments of the invention, but sintered at a cell pressure of, for example, up to about 5.5 GPa and at temperatures in which diamond is stable may exhibit a coercivity of about 100 Oe or less and/or a specific magnetic saturation of about 16 $G \cdot cm^3/g$ or more in at least a region thereof. Thus, in one or more embodiments, at least a region of the PCD table 102 exhibits metallic constituent content of less than 7.5 weight % and a greater amount of diamond-to-diamond bonding between diamond grains than that of at least a region of a PCD sintered at a lower pressure, but with the same precursor diamond particle size distribution and catalyst.

It is currently believed that forming the PCD table 102 by sintering diamond particles at a cell pressure of at least about 7.5 GPa may promote nucleation and growth of diamond between the diamond particles being sintered so that the volume of the interstitial regions of the PCD table 102 so formed is decreased compared to the volume of interstitial regions if the same diamond particle distribution was sintered at a pressure of, for example, up to about 5.5 GPa and at temperatures where diamond is stable. For example, the diamond may nucleate and grow from carbon provided by dissolved carbon in metal-solvent catalyst (e.g., liquefied cobalt) infiltrating into the diamond particles being sintered, partially graphitized diamond particles, carbon from a substrate, carbon from another source (e.g., graphite particles and/or fullerenes mixed with the diamond particles), or combinations of the foregoing. This nucleation and growth of diamond in combination with the sintering pressure of at least about 7.5 GPa may contribute to PCD table 102 so formed having a metallic constituent content of less than about 7.5 weight %.

Figure 2A:
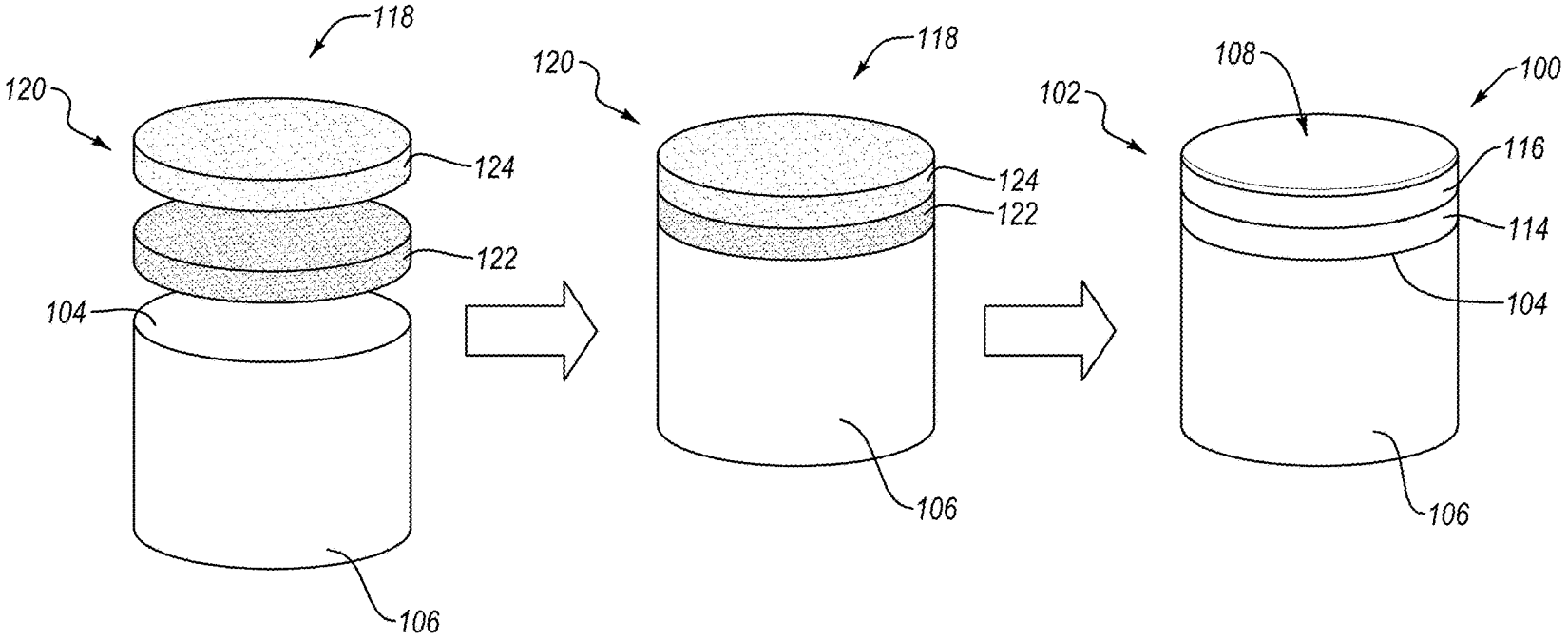
FIG. 2A is a schematic illustration of a method of fabricating the PDC shown in FIGS. 1A and 1B according to an embodiment.
Figure 2B:
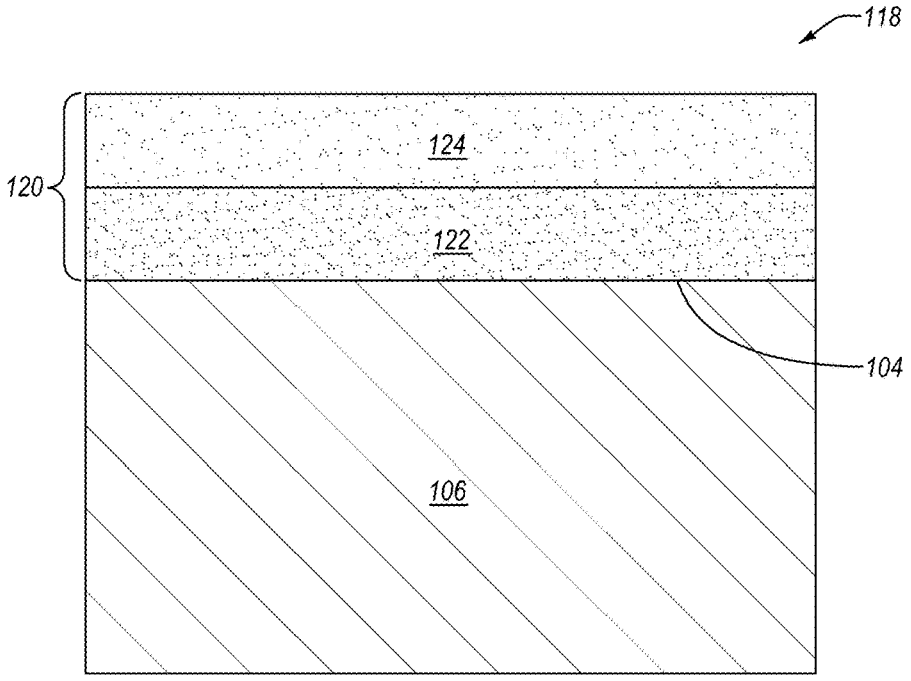
FIG. 2B is a cross-sectional view of the PDC assembly shown in FIG. 2A according to an embodiment.

FIG. 2A is a schematic illustration of a method for fabricating the PDC 100 shown in FIGS. 1A and 1B. FIGS. 2A and 2B illustrate a PDC precursor assembly 118 including a PCD precursor assembly 120 that includes a lower region 122. The lower region 122 includes diamond particles having a coarse average particle size using any of the lower average diamond grains sizes for the lower region 114 discussed above with respect to FIGS. 1A and 1B. The PCD precursor assembly 120 also includes an upper region 124 including diamond particles positioned adjacent to the lower region 122. The upper region 124 exhibits an upper average particle size that is less than the lower average particle size of the lower region 122 and comprises any of the upper average diamond grain sizes for the upper region 116 discussed above with respect to FIGS. 1A and 1B. In one or more embodiments, the lower region 122 may also include at least one additive including about 1 weight % to about 20 weight % (e.g., about 3 weight % to about 18 weight % or any of the previously disclosed concentrations for the at least one additive) of tungsten, tungsten carbide, sintered cemented tungsten carbide particles, or combinations thereof. For example, the at least one additive may be present in the lower region 122 in an amount of about 15 weight % or less, such as, about 1 weight % to about 15 weight %, about 1 weight % to about 5 weight %, about 2 weight % to about 4 weight %, less than about 5 weight %, about 2 weight % to about 5 weight %, about 3 weight % to about 6 weight %, about 4 weight % to about 6 weight %, about 1 weight % to about 10 weight %, about 3 weight % to about 10 weight %, about 2 weight % to about 15 weight %, about 10 weight % to about 20 weight %, about 5 weight % to about 15 weight %, or about 10 weight % to about 15 weight % of the lower region 122, with the balance of the lower region 122 being substantially diamond particles. In an embodiment, the at least one additive may include both tungsten and tungsten carbide. For example, tungsten may be present in the lower region 114 in an amount of about 5 weight % or less of the lower region 114, such as about 1 weight % to about 5 weight %, about 2 weight % to about 4 weight %, about 1 weight % to about 3 weight %, or about 2 weight % to about 3 weight %; and tungsten carbide may be present in the lower region 114 in an amount of about 15 weight % of the lower region 114 or less, such as, about 5 weight % to about 15 weight %, about 9 weight % to about 12 weight %, about 10 weight % to about 15 weight %, or about 10 weight % to about 11 weight %. In some embodiments, the at least one additive may include more than about 5 weight % of tungsten and more than about 15 weight % of tungsten carbide. In an embodiment, the at least one additive in the lower region 114 may include about 9 weight % to about 12 weight % of tungsten carbide and about 1 weight % to about 4 weight % of tungsten.

In some embodiments, the upper region 124 may be substantially free of the at least one additive, while in other embodiments, a small amount of the at least one additive (e.g., less than the amount present in the lower region 122) may migrate into the upper region 124 during HPHT processing. The precursor assembly 118 may include the cemented carbide substrate 106 positioned adjacent to the lower region 122. For example the cemented carbide substrate 106 may be a fine grain cemented tungsten carbide substrate having an average tungsten particle size of about 3 μm or smaller, as previously discussed.

Although the illustrated embodiment of the PDC precursor assembly 118 shown in FIGS. 2A and 2B only utilizes two distinct regions of diamond particles, two or more, or more than three regions may be employed. In an embodiment, each region may have a progressively smaller average diamond particle size than the previous region with distance away from the cemented carbide substrate 106.

Referring to FIG. 2B, the PDC precursor assembly 118 may be subjected to an HPHT process to form the PDC 100 (shown in FIGS. 1A, 1B, 2A, and 2C). The PCD precursor assembly 120 and the cemented carbide substrate 106 may be placed in a pressure transmitting medium to form the PDC precursor assembly 118. For example, the pressure transmitting medium may include a refractory metal can, graphite structure, pyrophyllite, other pressure transmitting structures, or combinations thereof. Examples of suitable gasket materials and cell structures for use in manufacturing PCD are disclosed in U.S. Pat. Nos. 6,338,754 and 8,236,074, each of which is incorporated herein, in its entirety, by this reference. Another example of a suitable pressure transmitting material is pyrophyllite, which is commercially available from Wonderstone Ltd. of South Africa. The PDC precursor assembly 118, including the pressure transmitting medium and the diamond particles and cemented carbide substrate 106 therein, is subjected to an HPHT process at diamond-stable conditions using an ultra-high pressure press at a temperature of at least about 1000° C. (e.g., about 1100° C. to about 2200° C., or about 1200° C. to about 1450° C.) and a cell pressure in the pressure transmitting medium of at least about 5 GPa (e.g., about 5.0 GPa to about 6.5 GPa, about 7.5 GPa to about 15 GPa, or at least about 7.5 GPa) for a time sufficient to sinter the diamond particles together in the presence of the metal-solvent catalyst and form the PCD table 102 comprising directly bonded-together diamond grains defining interstitial regions occupied by a metal-solvent catalyst. For example, the pressure in the pressure transmitting medium employed in the HPHT process may be at least about 7.5 GPa, at least about 9.0 GPa, at least about 10.0 GPa, at least about 11.0 GPa, at least about 12.0 GPa, or at least about 14 GPa.

The pressure values employed in the HPHT processes disclosed herein refer to the pressure in the pressure transmitting medium (i.e., cell pressure) at room temperature (e.g., about 25° C.) with application of pressure using an ultra-high pressure press and not the pressure applied to the exterior of the PDC precursor assembly 118. The actual pressure in the pressure transmitting medium at sintering temperature may be slightly higher.

The PDC 100 so formed (FIG. 2C) includes the PCD table 102 in which the lower and upper regions 114 and 116 thereof are integrally formed with the substrate 106 and bonded to the interfacial surface 104 of the cemented carbide substrate 106. During the HPHT process, the cobalt-containing cementing constituent of the cemented carbide substrate 106 may liquefy and a portion of the cobalt-containing cementing constituent may infiltrate into the lower and upper regions 122 and 124 to promote growth between adjacent diamond particles to catalyze formation of the PCD table 102. Although the lower (e.g., larger or coarse) average diamond particle size of the lower region 122 acts to limit infiltration of the liquefied infiltrant into the upper region 124 of diamond particles, the cobalt-containing cementing constituent may still infiltrate into and be present in the upper region 116 of the PCD table 102.

As described above, the interfacial surface 104 may be substantially planar as shown in FIGS. 1A-3C. In some embodiments, the interfacial surface 104 may be non-planar, such as exhibiting a wave or tooth-like pattern; a domed, semielliptical, semispherical, rectilinear, or other geometric configuration along the interfacial surface 104. Suitable interfacial surface topographies or configurations are disclosed in U.S. Pat. No. 8,297,382, which is incorporated herein, in its entirety, by this reference.

Figure 2C:
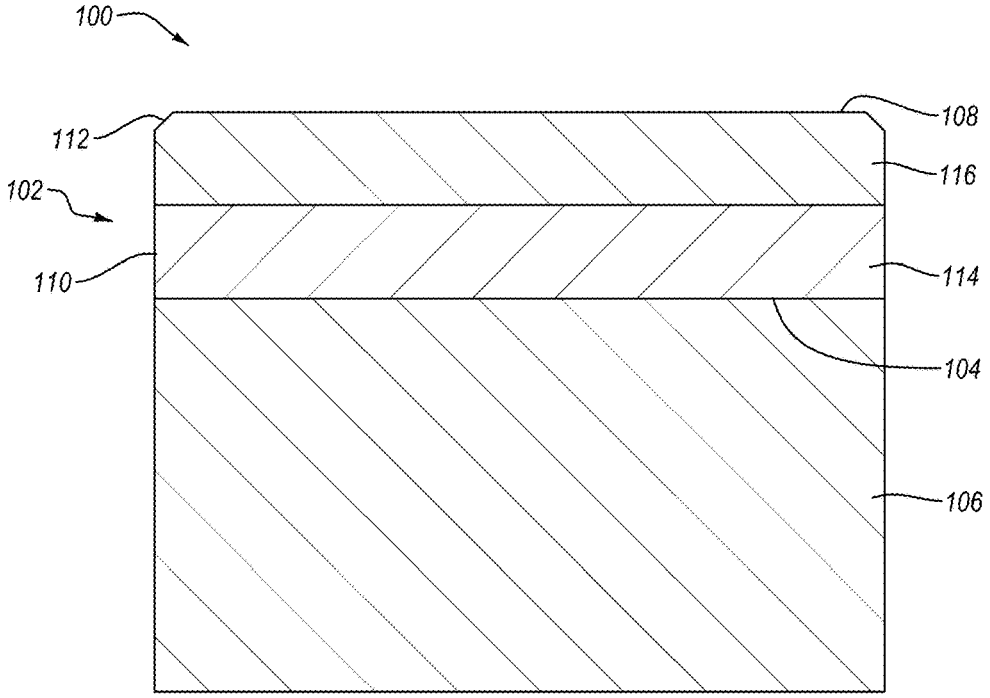
FIG. 2C is a cross-sectional view of the PDC fabricated by HPHT processing the PDC assembly shown in FIGS. 2A and 2B according to an embodiment.
Figure 2D:
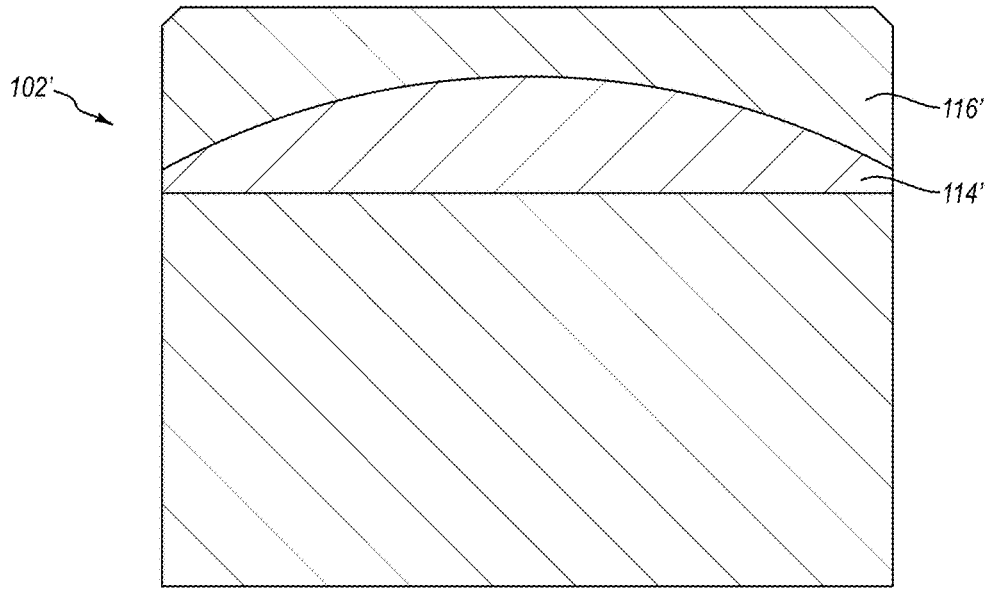
FIGS. 2D-2G are cross-sectional views illustrating different geometries for the two regions in the PCD table shown in FIG. 2C according to various embodiments.
Figure 2E:
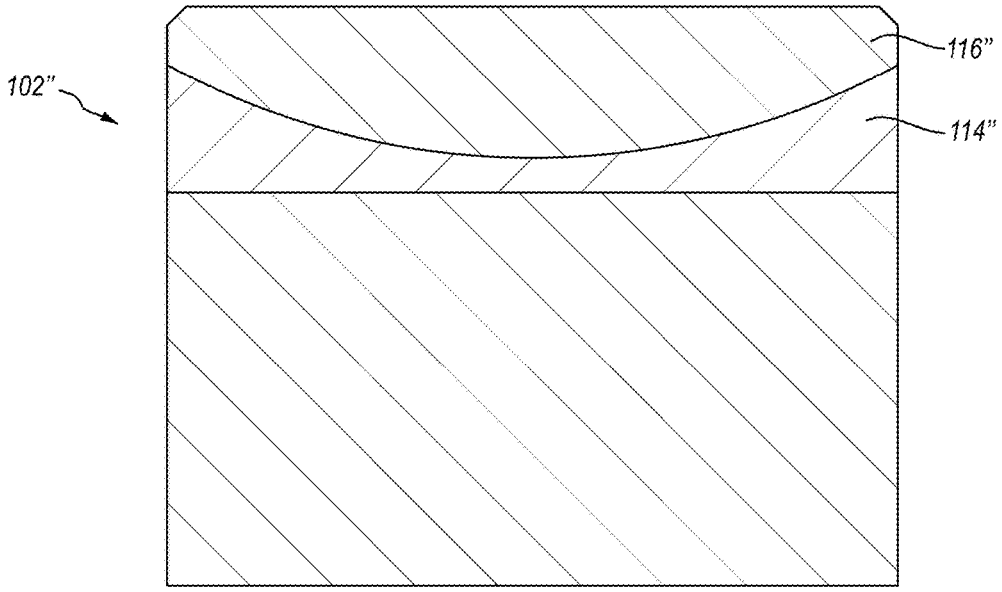
Figure 2F:
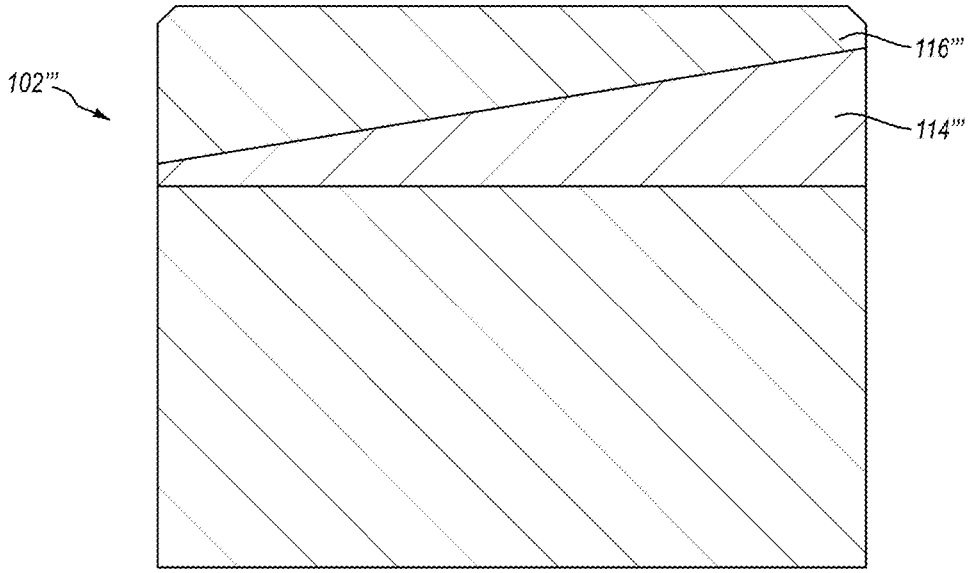
Figure 2G:
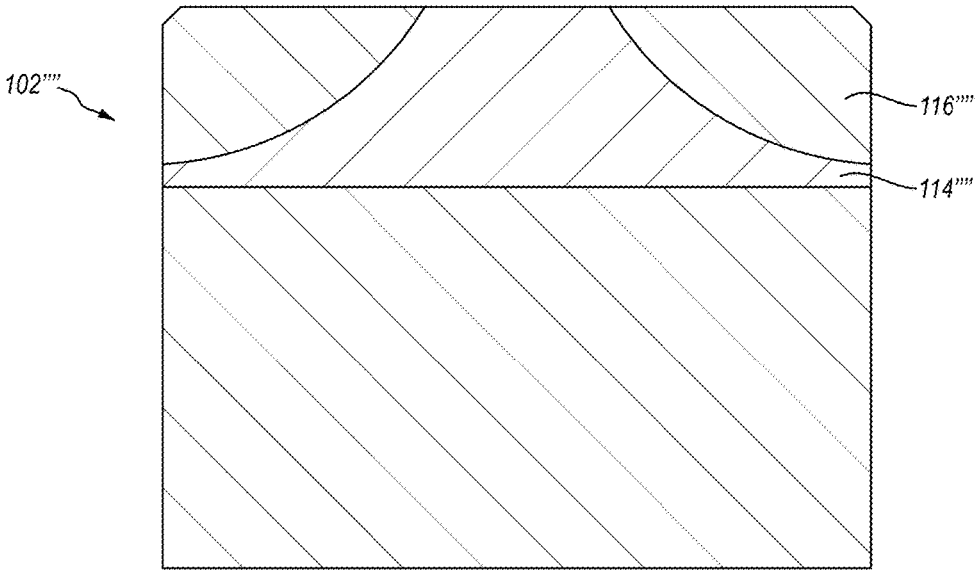

FIGS. 2D-2G are cross-sectional views illustrating different geometries for the lower and upper regions 114 and 116 of the PCD table 102 shown in FIG. 2C according to various embodiments. The lower and upper regions 114 and 116 may exhibit a variety of different geometries that depart from the geometries illustrated in FIG. 2C. For example, referring to FIG. 2D, a lower region 114' may exhibit a convex configuration, while an upper region 116' may exhibit a correspondingly configured concave geometry that at least partially receives the convex portion of the lower region 114'. As shown in FIG. 2E, a lower region 114" may exhibit a concave configuration, while an upper region 116" may exhibit a correspondingly configured convex geometry that is at least partially received by the lower region 114". Referring to FIG. 2F, in other embodiments, a lower region 114''' and an upper region 116''' may exhibit a gradual increase/decrease in thickness thereof across a lateral dimension (e.g., a diameter) of the PCD table 102'''. In another embodiment, illustrated in FIG. 2G, a lower region 114'''' exhibits a geometry that includes a generally central portion, while an upper region 116'''' forms at least one cutting region at and about a periphery of the PCD table 102''''. For example, the upper region 116'''' may be annularly shaped and extend circumferentially about the generally central portion. The geometries for various regions shown in FIGS. 2D-2G may be fabricated by using molds and/or binders to hold the diamond particles into the desired geometry during HPHT processing. Although the illustrated embodiments of the PDCs shown in FIGS. 2C-2G utilize two distinct regions of diamond particles, two or more, or more than three regions may be employed using geometrical configurations similar to those illustrated, or configurations that may vary from those illustrated.

Figure 3A:
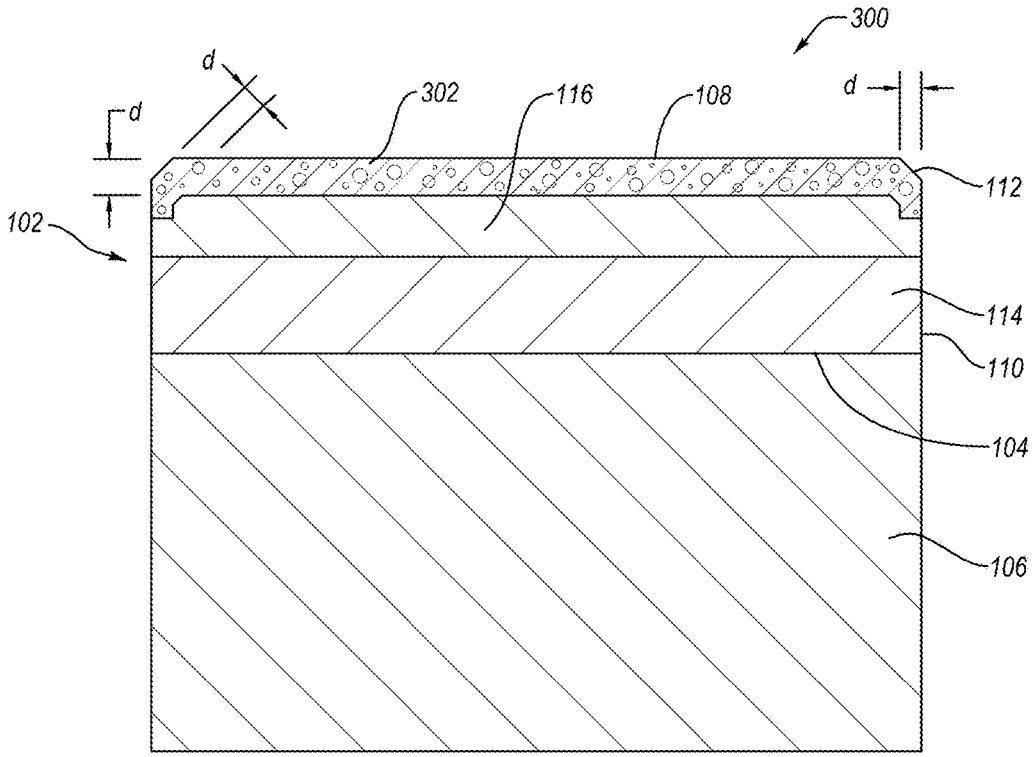
FIG. 3A is a cross-sectional view of the PDC shown in FIGS. 1A, 1B, and 2C in which a PCD table thereof has been at least partially leached.

Referring to FIG. 3A, in another embodiment, after HPHT processing, the metallic constituent (e.g., the cobalt-containing cementing constituent from the cemented carbide substrate 106) may be leached from at least a region of the PCD table 102 shown in FIG. 2C to a selected depth using an acid leaching or a gaseous leaching process. For example, FIG. 3A is a cross-sectional view of an embodiment of a PDC 300 in which the metallic constituent is at least partially leached from a portion of the PCD table 102 to a selected depth "d" as measured from at least one of the upper surface 108, at least one lateral surface 110, or chamfer 112 to form a leached region 302 that is at least partially depleted of the metallic constituent. For example, the leached region 302 may generally contour the upper surface 108, the chamfer 112, and the at least one lateral surface 110. The leached region 302 may also extend along a selected length of the at least one lateral surface 110. The leached region 302 may include only a portion of the lower region 114 of the PCD table 102, or may include substantially all of the lower region 114 and/or a portion of or substantially the entire upper region 116. Generally, the selected depth "d" may be greater than 250 μm, greater than 300 μm to about 425 μm, greater than 350 μm to about 400 μm, greater than 350 μm to about 375 μm, about 375 μm to about 400 μm, about 500 μm to about 650 μm, about 400 μm to about 600 μm, about 600 μm to about 800 μm, or about 10 μm to about 500 μm. In some embodiments, the leached region 302 may be positioned entirely within the initial cutting region, at least a portion of the upper region 116, a portion of the lower region 114, or combinations thereof.

A residual amount of the metallic constituent may still be present in the leached region 302 even after leaching. For example, the metallic constituent may comprise about 0.8 weight % to about 1.50 weight % and, more particularly, about 0.9 weight % to about 1.2 weight % of the leached region 302. The leaching may be performed in a suitable acid (e.g., aqua regia, nitric acid, hydrochloric acid, hydrofluoric acid, or combinations thereof) so that the leached region 302 of the PCD table 102 is substantially free of the metallic constituent. Leaching in an acid may be carried out under elevated temperatures and/or elevated pressure. As a result of the metallic constituent being depleted from the leached region 302, the at least partially leached PCD table 102 is relatively more thermally stable than prior to leaching.

In some embodiments, leaching may be accomplished by exposing the PCD table 102 to a gaseous leaching agent that is selected to substantially remove metallic constituent from the interstitial regions of the PCD table 102. For example, a gaseous leaching agent may be selected from a halide gas, at least one inert gas, a gas from the decomposition of an ammonium halide salt, hydrogen gas, carbon monoxide gas, an acid gas, or mixtures thereof. In an embodiment, a reaction chamber may be filled with a gaseous leaching agent of about 10 volume % to about 20 volume % chlorine with the balance being argon and the gaseous leaching agent being at an elevated temperature of at least about 300° C. to about 800° C. Additional details about gaseous leaching processes for leaching PCD elements, including types of gaseous leaching agents and volume of each used in leaching, and elevated temperatures, are disclosed in U.S. application Ser. No. 13/324,237, which is incorporated herein, in its entirety, by this reference.

Figure 3B:
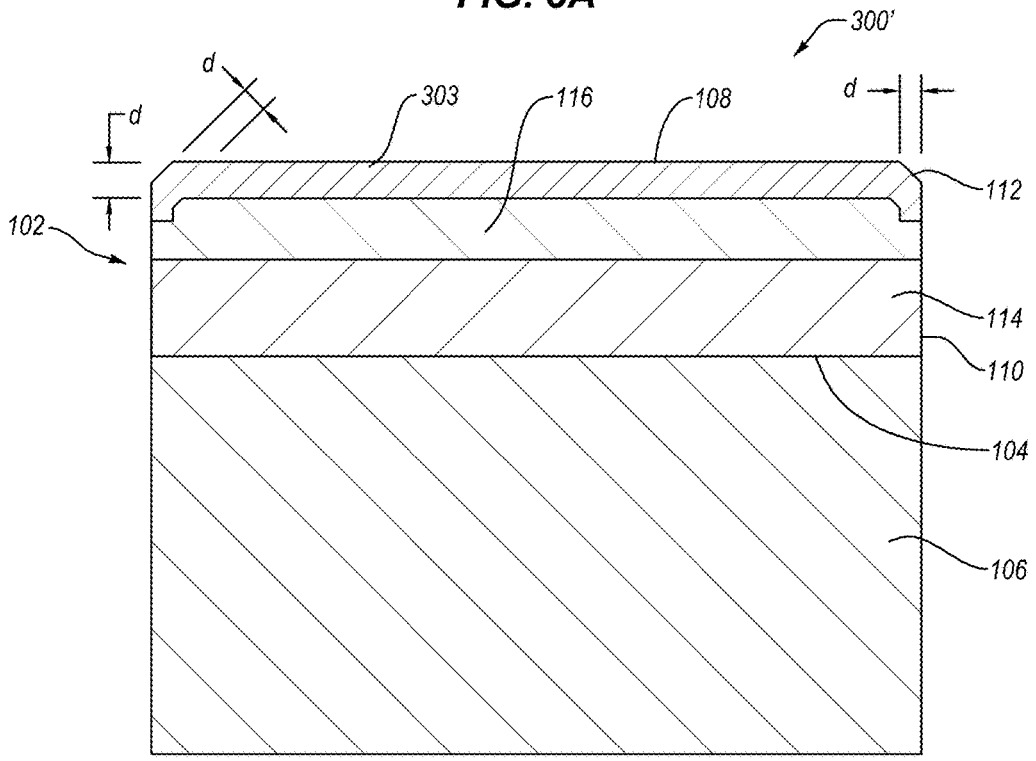
FIG. 3B is a cross-sectional view of the PDC shown in FIG. 3A after infiltrating the leached region of the PCD table with an infiltrant/replacement material according to an embodiment.

FIG. 3B is a cross-sectional view of the PDC 300' after optionally infiltrating the leached region 302 (shown in FIG. 3A) of the PCD table 102 to form an infiltrated region 303. The infiltrant may be selected from silicon, silicon-cobalt alloys, a nonmetallic catalyst, nonmetallic infiltrants, or combinations of the foregoing. For example, the nonmetallic catalyst may be selected from a carbonate (e.g., one or more carbonates of Li, Na, K, Be, Mg, Ca, Sr, and Ba), a sulfate (e.g., one or more sulfates of Be, Mg, Ca, Sr, and Ba), a hydroxide (e.g., one or more hydroxides of Be, Mg, Ca, Sr, and Ba), elemental phosphorous and/or a derivative thereof, a chloride (e.g., one or more chlorides of Li, Na, and K), elemental sulfur and/or a derivative thereof, a polycyclic aromatic hydrocarbon (e.g., naphthalene, anthracene, pentacene, perylene, coronene, or combinations of the foregoing) and/or a derivative thereof, a chlorinated hydrocarbon and/or a derivative thereof, a semiconductor material (e.g., germanium or a germanium alloy), or combinations of the foregoing.

One suitable carbonate catalyst is an alkali metal carbonate material including a mixture of sodium carbonate, lithium carbonate, and potassium carbonate that form a low-melting ternary eutectic system. This mixture and other suitable alkali metal carbonate materials are disclosed in U.S. Pat. No. 8,734,552, which is incorporated herein, in its entirety, by this reference. The alkali metal carbonate material disposed in the interstitial regions of the infiltrated region 303 may be partially or substantially completely converted to one or more corresponding alkali metal oxides by suitable heat treatment following infiltration.

The interfacial surface 104 of the cemented carbide substrate 106 may be substantially free of abnormal grain growth of tungsten carbide grains, which can project into the PCD table 102 and promote de-bonding thereof from the cemented carbide substrate 106. For example, the tungsten carbide grains exhibiting abnormal grain growth may comprise about 5% or less of the total surface area of the interfacial surface 104, such as greater than 0 to about 5%, about 1% to about 4%, about 2% to about 4%, about 3% or less, or about 1% to about 2%. The extent of any abnormal grain growth of tungsten carbide grains at the interfacial surface 104 may be determined via a number of suitable analytical techniques, such as quantitative optical or electron microscopy, ultrasonic imaging, x-ray radiography, or other suitable technique. The inventors currently believe that this is due to the relatively fine tungsten carbide grain size of the cemented carbide substrate 106, which limits the amount of cobalt-containing cementing constituent exposed to diamond particles during the HPHT sintering process that serve as a carbon source for abnormal growth of the tungsten carbide grains. However, abnormal grain growth at the interfacial surface 104 may also be substantially eliminated when the PCD table 102 is preformed and bonded to the interfacial surface 104 of the cemented carbide substrate 106. In a cobalt-cemented tungsten carbide substrate having an average tungsten carbide grain size of about 3 μm, the inventors found the presence of abnormal grain growth of tungsten carbide grains (also known as carbide plumes) at the interfacial surface 104 using ultrasonic testing, while cobalt-cemented tungsten carbide substrates having an average tungsten carbide grain size of about 1.3 μm according to an embodiment of the invention was substantially free of abnormal grain growth of tungsten carbide grains at the interfacial surface 104 as also confirmed by ultrasonic testing. Tungsten carbide grains that exhibit abnormal grain growth generally exhibit an elongated geometry having an average grain size and aspect ratio that is about 2 times or more (e.g., about 3 to about 8 times, or about 3 to about 5 times) than generally equiaxed tungsten carbide grains of the cemented carbide substrate 106. For example, tungsten carbide grains that exhibit abnormal grain growth may have an average length of about 8 μm to about 15 μm, such as, about 8 μm to about 10 μm.

In any of the embodiments disclosed herein, the cobalt-containing cementing constituent of the cemented carbide substrate 106 may exhibit a substantially continuous concentration gradient such that a first portion of the cemented carbide substrate 106 (e.g., at or near a center of the substrate) has a different cobalt-containing cementing constituent concentration than a second portion (e.g., at or near an outer lateral surface) of the cemented carbide substrate 106. The concentration gradient may be substantially continuous so that no abrupt change in concentration occurs, but that the concentration gradient smoothly increases or decreases with increasing distance from the first portion to the second portion. Providing relatively lower cementing constituent concentration in one portion (e.g., at or near the outer surface of the substrate) provides increased hardness and wear resistance to this portion relative to another portion with higher cementing constituent concentration. The higher cobalt-containing cementing constituent concentration provides increased toughness to this corresponding portion. For example, it may be desirable to provide increased toughness at or near the center of the cemented carbide substrate, while providing increased wear resistance at or near the outer lateral surface of the cemented carbide substrate. Characteristics that can be so tailored through manipulation of the concentration gradient of the cobalt-containing cementing constituent include, but are not limited to, toughness, wear resistance, abrasion resistance, erosion resistance, corrosion resistance, thermal stability, and combinations thereof. Additional details regarding different suitable embodiments for the cemented carbide substrate 106 having a cementing constituent concentration gradient and techniques for fabricating such cementing constituent concentration gradients in a cemented carbide substrate are disclosed in U.S. patent application Ser. No. 14/081,960 filed on 15 Nov. 2013, the disclosure of which is incorporated herein, in its entirety, by this reference.

In other embodiments, the PCD table 102 may be initially formed using an HPHT sintering process (i.e., a preformed PCD table) and, subsequently, bonded to the interfacial surface 104 of the substrate 106 by brazing, using a separate HPHT bonding process, or any other suitable joining technique, without limitation. For example, the PCD table 102 may be HPHT sintered and then separated from the cemented carbide substrate 106 using any suitable material removal process, such as grinding, lasing, or machining (e.g., milling, or electro-discharge machining). In another embodiment, a PCD table may be HPHT sintered without a cemented carbide substrate. The PCD table 102 may be leached to at least partially remove or to remove substantially all of the metallic constituent therein. The leached PCD table 102 may be placed with the lower region 114 adjacent to another cemented carbide substrate 106 and subjected to any of the HPHT processes disclosed herein so that a metallic infiltrant such as the cobalt-containing cementing constituent from the cemented carbide substrate 106 re-infiltrates into the leached PCD table 102. The infiltrated PCD table 102 bonds to the cemented carbide substrate 106 during cooling from the HPHT process.

For example, in another embodiment, the PCD assembly 120 shown in FIG. 2B may be replaced with another type of diamond volume. For example, the diamond particle layers 122 and 124 of diamond particles may be replaced with a preformed, porous, at least partially leached PCD table having more than one region therein, the preformed, at least partially leached PCD table being infiltrated with the cobalt-containing cementing constituent from the cemented carbide substrate 106 and attached thereto during an HPHT process using any of the diamond-stable HPHT process conditions disclosed herein. For example, the cobalt-containing cementing constituent from the cemented carbide substrate 106 shown in FIG. 2B may partially or substantially completely infiltrate into the at least partially leached PCD table. Upon cooling from the HPHT process, a strong metallurgical bond is formed between the infiltrated PCD table and the cemented carbide substrate to form a PDC having a structure that may be similar to the PDC 100.

The at least partially leached PCD table may be formed by HPHT sintering more than one layer of a plurality of diamond particles having any of the aforementioned diamond particle size distributions in the presence of a metal-solvent catalyst (e.g., iron, nickel, cobalt, or alloys thereof) under any of the disclosed diamond-stable HPHT conditions. For example, the metal-solvent catalyst may be infiltrated into the diamond particles from a metal-solvent-catalyst disc (e.g., a cobalt disc), infiltrated from a cobalt-cemented tungsten carbide substrate, mixed with the diamond particles, or combinations of the foregoing. At least a portion of or substantially all of the metal-solvent catalyst (and, optionally one or more of any of the additives described herein) may be removed from the sintered PCD body by leaching. For example, the metal-solvent catalyst may be at least partially removed from the sintered PCD table by immersion in an acid, such as aqua regia, nitric acid, hydrofluoric acid, or other suitable acid, to form the at least partially leached PCD table. The sintered PCD table may be immersed in the acid for about 2 to about 7 days (e.g., about 3, 5, or 7 days) or for a few weeks (e.g., about 4 weeks) depending on the amount of leaching that is desired. It is noted that a residual amount of the metal-solvent catalyst and/or other interstitial materials may still remain even after leaching for extended periods of time.

When the metal-solvent catalyst is infiltrated into the layers of diamond particles from a cemented tungsten carbide substrate including tungsten carbide grains cemented with a metal-solvent catalyst (e.g., cobalt, nickel, iron, or alloys thereof), the infiltrated metal-solvent catalyst may carry tungsten and/or tungsten carbide therewith. The at least partially leached PCD table may include such tungsten and/or tungsten carbide therein disposed interstitially between the bonded diamond grains. The tungsten and/or tungsten carbide may be at least partially removed by the selected leaching process or may be relatively unaffected by the selected leaching process.

If desired, after infiltrating and bonding the at least partially leached PCD table to the cemented carbide substrate 106, the cobalt-containing cementing constituent that occupies the interstitial regions may be at least partially removed in a subsequent leaching process using an acid (e.g., aqua regia, nitric acid, hydrofluoric acid, or other suitable acid) to form, for example, the leached region 302 shown in FIG. 3A. If desired, the leached region 302 may be infiltrated with any of the infiltrant materials disclosed herein. When an infiltrant material is infiltrated from the upper working surface of the PCD table, the infiltrated PCD table may be the same or substantially similar to that depicted in FIG. 3B.

Figure 3C:
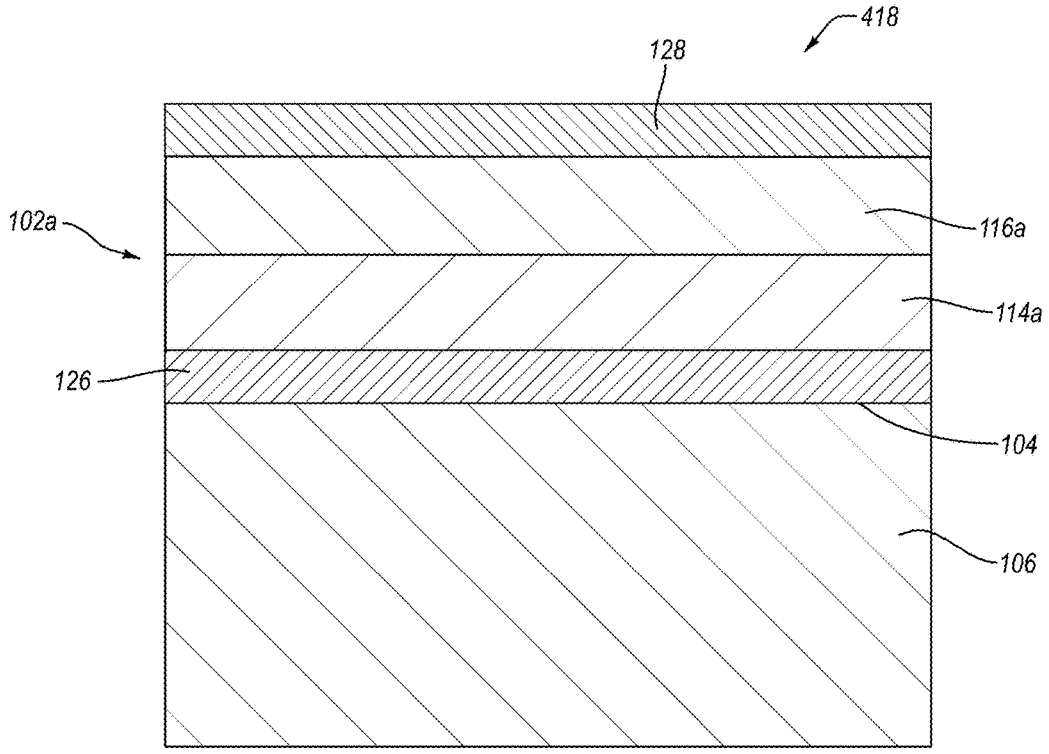
FIG. 3C is a cross-sectional view of a PDC assembly including an at least partially leached table and infiltrants according to an embodiment.

Referring to FIG. 3C, in other embodiments, one or more other metallic infiltrants may be disposed between an at least partially leached PCD table 102*a* and the cemented carbide substrate 106 and/or at least partially enclose the at least partially leached PCD table 102*a*, with a lower region 114*a* thereof having a relatively coarse grain size disposed adjacent to the cemented carbide substrate 106 and an upper region 116*a* thereof having a relatively fine grain size positioned remote from the cemented carbide substrate. Such infiltrants may partially or substantially completely infiltrate into the at least partially leached PCD table 102*a*, to result in an infiltrated PCD table.

FIG. 3C is a cross-sectional view of an assembly 418 to be HPHT processed in which an at least partially leached PCD table 102*a* is infiltrated from both sides thereof with different infiltrants according to an embodiment of a method. Such an embodiment may better facilitate infiltration of the porous, at least partially leached PCD 102*a* when the at least partially leached PCD table 102*a* is formed at a cell pressure greater than about 7.5 GPa and has relatively small interstitial region pore volume. The assembly 418 includes a first infiltrant 126 disposed between the at least partially leached PCD table 102*a* and the cemented carbide substrate 106. The first infiltrant 126 may be in the form of a foil, powder, paste, or disc. A second infiltrant 128 may be disposed adjacent to the upper region 116*a* of the at least partially leached PCD table 102*a* such that the at least partially leached PCD table 102*a* is disposed between the first infiltrant 126 and the second infiltrant 128.

The first and second infiltrants 126 and 128 may be formed from a variety of different metals and alloys. For example, the first infiltrant 126 may be formed from metal solvent catalysts and alloys thereof such as, a nickel-silicon alloy, a nickel-silicon-boron alloy, a cobalt-silicon alloy, cobalt-silicon-boron alloy, or combinations thereof. Examples of nickel-silicon alloys, nickel-silicon-boron alloys, cobalt-silicon alloys, and cobalt-silicon-boron alloys that may be used for the first infiltrant 126 are disclosed in U.S. patent application Ser. No. 13/795,027 filed on 12 Mar. 2013, the disclosure of which is incorporated herein, in its entirety, by this reference.

In embodiments, the second infiltrant 128 may have a melting temperature or liquidus temperature at standard pressure of less than about 1300° C. The second infiltrant may also be more readily removed (e.g., leached) from the PCD table than a pure cobalt or pure nickel infiltrant, or cobalt provided from a cobalt-cemented tungsten carbide substrate. Examples of metals and alloys for the second infiltrant 128 that may facilitate faster, more complete leaching include, but are not limited to copper, tin, germanium, gadolinium, magnesium, lithium, silver, zinc, gallium, antimony, bismuth, cupro-nickel, mixtures thereof, alloys thereof, and combinations thereof. Examples of metal and alloys that may be used for the second infiltrant 128 are disclosed in U.S. patent application Ser. No. 13/795,027. Further, the second infiltrant may comprise any of the infiltrant materials described herein for infiltrating an upper region of a PCD table.

The assembly 418 may be subjected to any of the HPHT process conditions disclosed herein during which the first infiltrant 126 liquefies and infiltrates into the at least partially leached PCD table 102*a* along with the second infiltrant 128. Depending on the volume of the porosity in the at least partially leached PCD table 102*a* and the volumes of the first and second infiltrants 126 and 128, a metallic infiltrant from the cemented carbide substrate 106 (e.g., cobalt from a cobalt-cemented tungsten carbide substrate) may also infiltrate into the at least partially leached PCD table 102*a* following infiltration of the first infiltrant 126. Notwithstanding the depiction of separated, distinct infiltrants in FIG. 3A, in some embodiments, at least some of the interstitial regions of the infiltrated at least partially leached PCD table 102*a* may be occupied by an alloy that is a combination of the first infiltrant 126, second infiltrant 128, and (if present) the cobalt-containing cementing constituent of the cemented carbide substrate 106. Such an alloy may have a composition that varies depending on its position throughout a thickness of the infiltrated at least partially leached PCD table 102*a*, and examples of which are disclosed in U.S. patent application Ser. No. 13/795,027. The alloy may be entirely in one region of the PCD table or in more than one region of the PCD table. In embodiments, the alloy or intermetallic compound may include at least one of nickel or cobalt; at least one of carbon, silicon, boron, phosphorus, cerium, tantalum, titanium, niobium, molybdenum, antimony, tin, or carbides thereof; and at least one of magnesium, lithium, tin, silver, copper, nickel, zinc, germanium, gallium, antimony, bismuth, gadolinium, or any of the other infiltrants described herein.

Upon cooling from the HPHT process, the infiltrated at least partially leached PCD table 102*a* attaches to the interfacial surface 104 of the cemented carbide substrate 106. After attaching the infiltrated at least partially leached PCD table 102*a* to the cemented carbide substrate 106, the infiltrated at least partially leached PCD table 102*a* may be shaped (e.g., chamfering) and/or leached as disclosed in any of the embodiments disclosed herein (e.g., as shown and/or described with reference to FIGS. 1A, 1B, and 2) or according to any embodiment disclosed in the above-mentioned U.S. patent application Ser. No. 13/795,027. Of course, the at least partially leached PCD table 102*a* may be pre-chamfered prior to infiltration in some embodiments.

In other embodiments, the first and second infiltrants 126 and 128 may both be positioned on top of the at least partially leached PCD table 102*a* or between the at least partially leached PCD table 102*a* and the cemented carbide substrate 106. For example, the first infiltrant 126 may be disposed between the at least partially leached PCD table 102*a* and the second infiltrant 128. In other embodiments, the cementing constituent of the cemented carbide substrate 106 may comprise the first infiltrant 126.

It should be noted that a cemented carbide substrate of any PDC disclosed herein may exhibit any combination of values/ranges disclosed herein for average grain size of the tungsten carbide grains, amount of the cobalt-containing cementing constituent, transverse rupture strength, hardness, coercivity, magnetic saturation, depletion zone, and bulk Palmquist fracture toughness, and depletion zone concentration profile in combination with a PCD table exhibiting any combination of regions, average diamond grain sizes and modes, geometries, leaching states, infiltrant content, magnetic properties (e.g., coercivity or magnetic saturation), and physical properties (e.g., $G_{ratio}$, wear resistance, etc.).

As previously discussed, during the HPHT process, a portion of the cobalt-containing cementing constituent from the cemented carbide substrate 106 may liquefy and infiltrate into the diamond particles of at least one region 114 or 116. The infiltrated cobalt-containing cementing constituent functions as a catalyst that catalyzes formation of directly bonded-together diamond grains to sinter the diamond particles so that the PCD table 102 can be formed.

As a result of the cobalt-containing cementing constituent sweeping into the diamond grains or interstitial regions of a PCD table, the cemented carbide substrate 106 exhibits a deeper depletion zone of the cobalt-containing cementing constituent extending inwardly from the interfacial surface 104 of the cemented carbide substrate 106 than would be present if a conventional cobalt-cemented tungsten carbide substrate were used (e.g., Standard Grade—about 13 weight % cobalt, balance tungsten carbide grains of about 3 μm in average size). For example, in some embodiments, the cemented carbide substrate 106 may include a depletion zone that exhibits a depth extending inwardly from the interfacial surface 104 of about 30 μm to about 60 μm, about 30 μm to about 50 μm, about 30 μm to about 40 μm, about 30 μm to about 35 μm, or about 32 μm to about 45 μm. In some cases, the overall volume of the cobalt-containing cementing constituent depleted from the depletion zone may be the same or similar than if a conventional cobalt-cemented tungsten carbide substrate were employed, but the depletion zone may extend to a relatively deeper depth. The depletion zone adjacent to the interface may exhibit a Palmquist fracture toughness of about 6 $MPa \cdot m^{0.5}$ to about 9 $MPa \cdot m^{0.5}$ (e.g., about 7 $MPa \cdot m^{0.5}$ to about 8 $MPa \cdot m^{0.5}$, or about 6.5 $MPa \cdot m^{0.5}$ to about 8.5 $MPa \cdot m^{0.5}$), and the cemented carbide substrate 106 remote from the depletion zone may exhibit a bulk Palmquist fracture toughness is about 6 $MPa \cdot m^{0.5}$ to about 12 $MPa \cdot m^{0.5}$ (e.g., about 7 $MPa \cdot m^{0.5}$ to about 8 $MPa \cdot m^{0.5}$, or about 8 $MPa \cdot m^{0.5}$ to about 12 $MPa \cdot m^{0.5}$). Palmquist fracture toughness is determined by a method that uses the corner crack length of a Vickers hardness indentation in a material to derive the fracture toughness.

Figure 4A:
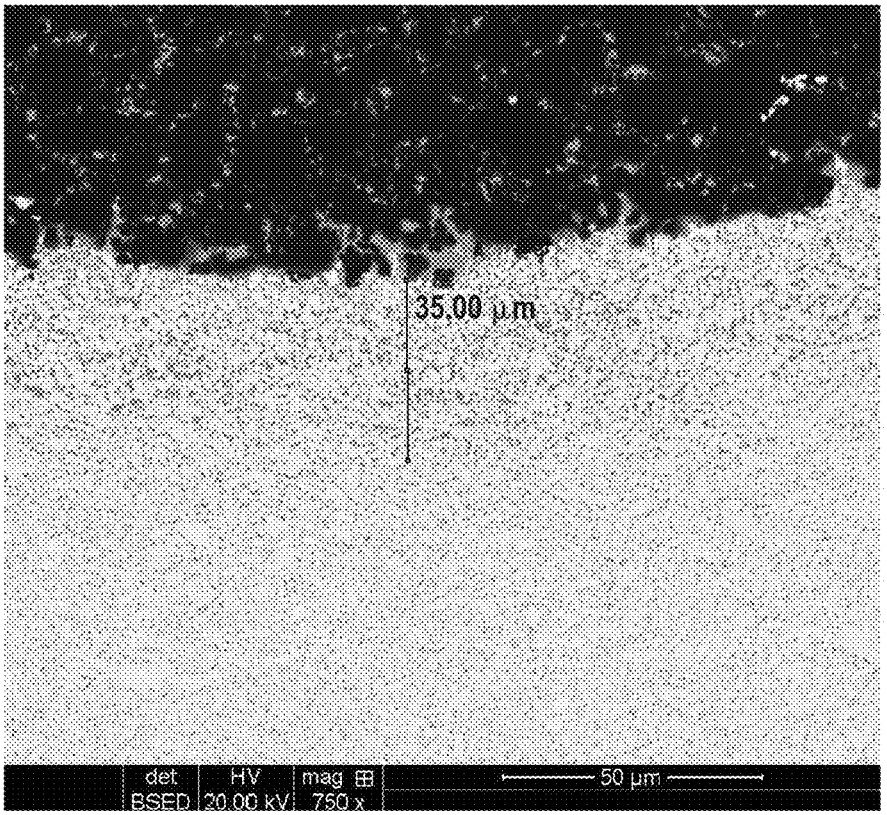
FIG. 4A is a scanning electron photomicrograph of the depletion zone in a cobalt-cemented tungsten carbide substrate of a PDC formed by HPHT sintering diamond particles on the cobalt-cemented tungsten carbide substrate having an average tungsten carbide grain size of about 1.3 μm or less and about 13 weight % cobalt and about 87 weight % tungsten carbide.
Figure 4B:
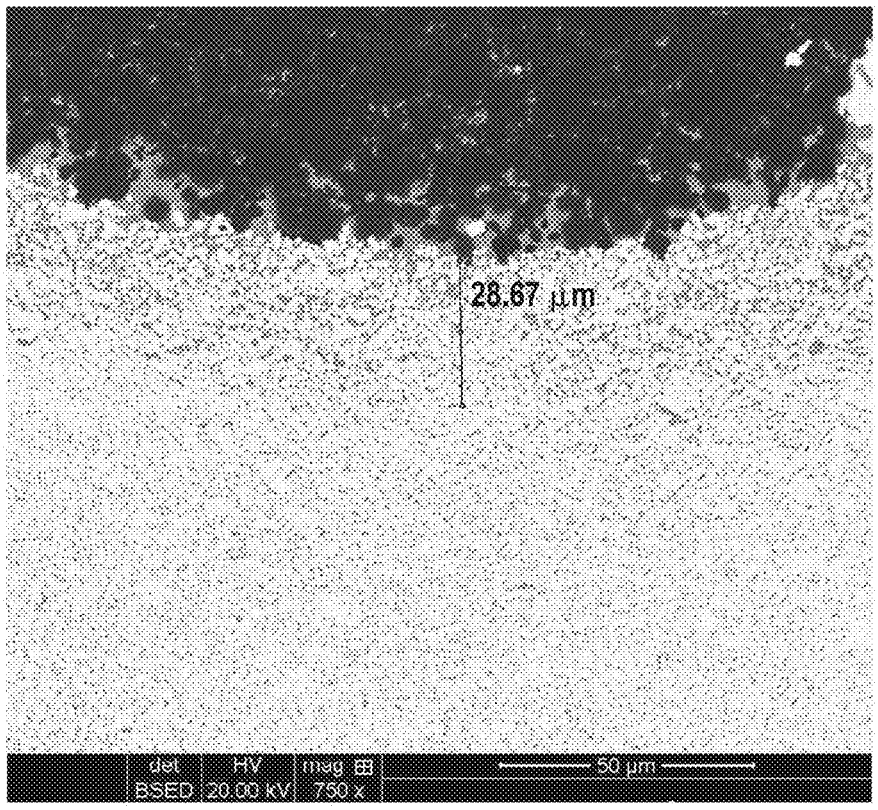
FIG. 4B is a scanning electron photomicrograph of the depletion zone in a cobalt-cemented tungsten carbide substrate of a PDC formed by HPHT sintering diamond particles on the cobalt-cemented tungsten carbide substrate having an average tungsten carbide grain size of about 3 μm and about 13 weight % cobalt and about 87 weight % tungsten carbide.

For example, FIG. 4A is a scanning electron photomicrograph of the depletion zone in a cobalt-cemented tungsten carbide substrate of a PDC formed by HPHT sintering diamond particles having an average particle size of about 19 μm on the cobalt-cemented tungsten carbide substrate having an average tungsten carbide grain size of about 1.3 μm or less and about 13 weight % cobalt and about 87 weight % tungsten carbide. As shown in FIG. 4A, the depletion zone in the cobalt-cemented tungsten carbide substrate was measured to be about 35 μm. As shown in FIG. 4B, the depletion zone in a cobalt-cemented tungsten carbide substrate having an average tungsten carbide grain size of about 3 μm and about 13 weight % cobalt and about 87 weight % tungsten carbide was measured to be about 29 μm. Similar depletion zone depths as shown in FIG. 4B are expected when the average diamond particles size in the lower region of the PCD table, nearest the cobalt-cemented tungsten carbide substrate, includes larger grain sizes, such as about 50 μm or more, by way of non-limiting example.

Figure 5:
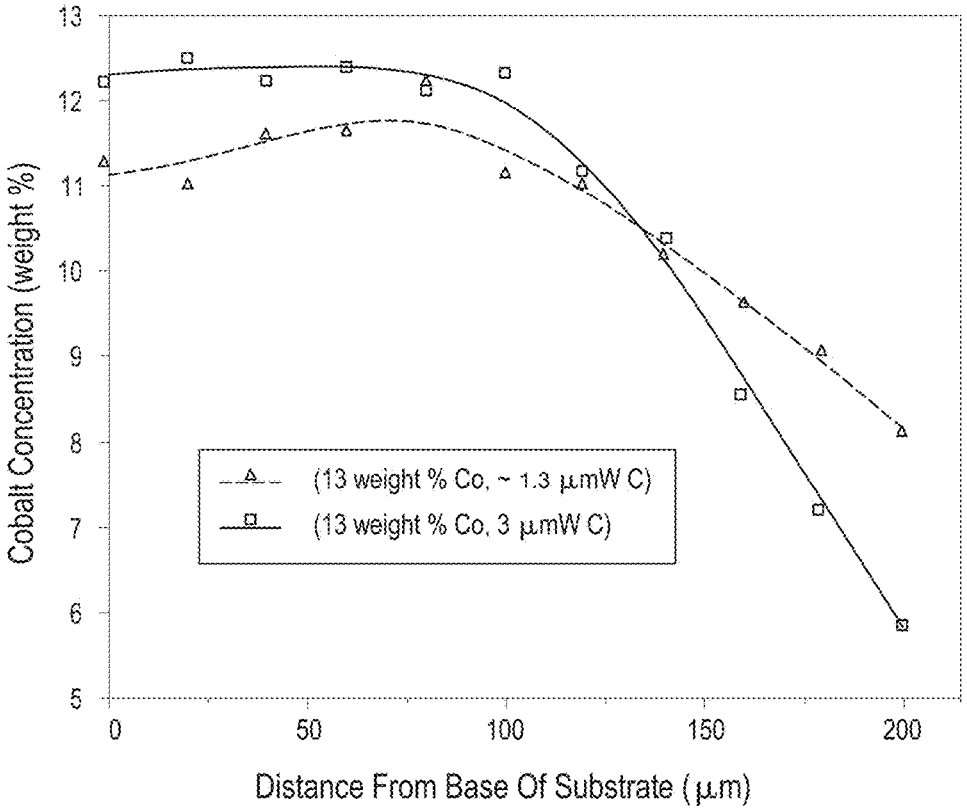
FIG. 5 is a graph of cobalt concentration with increasing distance from the base of the cobalt-cemented tungsten carbide substrate for one PDC sample according to an embodiment of the invention having an average tungsten carbide grain size of about 1.3 μm or less and about 13 weight % cobalt and about 87 weight % tungsten carbide, and another PDC sample having an average tungsten carbide grain size of about 3 μm or less and about 13 weight % cobalt and about 87 weight % tungsten carbide.

FIG. 5 is a graph of cobalt concentration with increasing distance from the base of the cobalt-cemented tungsten carbide substrate for one PDC sample according to an embodiment of the invention having an average tungsten carbide grain size of about 1.3 μm or less and about 13 weight % cobalt and about 87 weight % tungsten carbide, and another PDC sample having an average tungsten carbide grain size of about 3 μm or less and about 13 weight % cobalt and about 87 weight % tungsten carbide. As shown in FIG. 5, use of the relatively fine tungsten carbide grains having an average grain size of about 1.3 μm or less according to an embodiment of the invention provided for a more gradual decrease in cobalt concentration in the depletion zone compared to the sample that used an average tungsten carbide grain size of about 3 μm. For example, with the relatively fine 1.3 μm tungsten carbide grain size, the cobalt concentration may decrease from between a range of about 11 weight %-about 13 weight % to a range of about 7 weight %-about 8 weight % proximate to the interfacial surface with the PCD table. Stated another way, the cobalt concentration may decrease by about 20% to about 40% (e.g., about 20% to about 30%, or about 22% to about 25%) proximate to the interfacial surface from the cobalt concentration proximate to the base of the cobalt-cemented tungsten carbide substrate (i.e., bulk concentration of the cobalt).

The deeper depletion zone is believed to provide a more gradual transition layer. This more gradual transition layer may help prevent braze cracking (also known as liquid metal embrittlement) when the cemented carbide substrate 106 is brazed to another structure, such as a bit body of a rotary drill bit.

The PDCs according to an embodiment of the invention having the about 1.3 μm average grain size tungsten carbide grains are currently believed by the inventors to exhibit a significantly higher survival probability than PDCs having a cemented carbide substrate with an average tungsten grain size of about 3 μm when subjected to impact testing in which a weight is vertically dropped on a sharp, non-chamfered edge of a PCD table of a PDC to impact the edge with 40 J of energy. The inventors currently believe that this lower probability of failure may be due to the lower amount of cobalt depleted from the depletion zone adjacent to the interface compared to a standard PDC. Such a configuration may exhibit a higher Palmquist fracture toughness in the depletion zone adjacent to the PCD table. Put another way, the depletion zone according to embodiments of the invention retains a higher weight % of cobalt adjacent to the interface than conventional PDCs. When failure occurred, failure after impact extended through the PCD table to the depletion zone.

Further, the cemented tungsten carbide substrates having about 1.3 μm average grain size tungsten carbide grains and about 13 weight % cobalt and about 87 weight % tungsten carbide may exhibit improved corrosion resistance compared to a cemented tungsten carbide substrate with an average tungsten carbide grain size of about 3 μm or less and about 13 weight % cobalt/about 87 weight % tungsten carbide. For example, immersing a polished surface of both types of cemented tungsten carbide substrates in 10% hydrochloric acid for about 24 hours may generate significantly wider corrosion pits in the cemented tungsten carbide substrate with the 3 μm tungsten carbide grain size. The corrosion pits in the cemented tungsten carbide substrate with the 3 μm tungsten carbide grain size may be 5 times wider than those in the cemented tungsten carbide substrate having average tungsten grain size of 1.3 μm. For example, corrosion pits in the cemented tungsten carbide substrate with the 1.3 μm tungsten carbide grain size may be about ⅕ times or less wide, about ¼ to about ⅕ times wide, about ⅓ to about ⅕ times wide, about ½ to about ¼ times wide, or about ⅓ to about ¼ wide than that of the corrosion pits in the cemented tungsten carbide substrate having average tungsten grain size of 3 μm. For example, the corrosion pits in the cemented tungsten carbide substrate with the 3 μm tungsten carbide grain size may have an average width of about 3 μm to about 6 μm and the corrosion pits in the cemented tungsten carbide substrate having average tungsten grain size of 1.3 μm may have an average width of about 0.5 μm to about 2.5 μm, such as about 1.5 μm to about 2 μm, or about 1.8 μm to about 1.85 μm, or about 1 μm to about 1.5 μm after immersing in 10% hydrochloric acid for 24 hours.

Figure 6A:
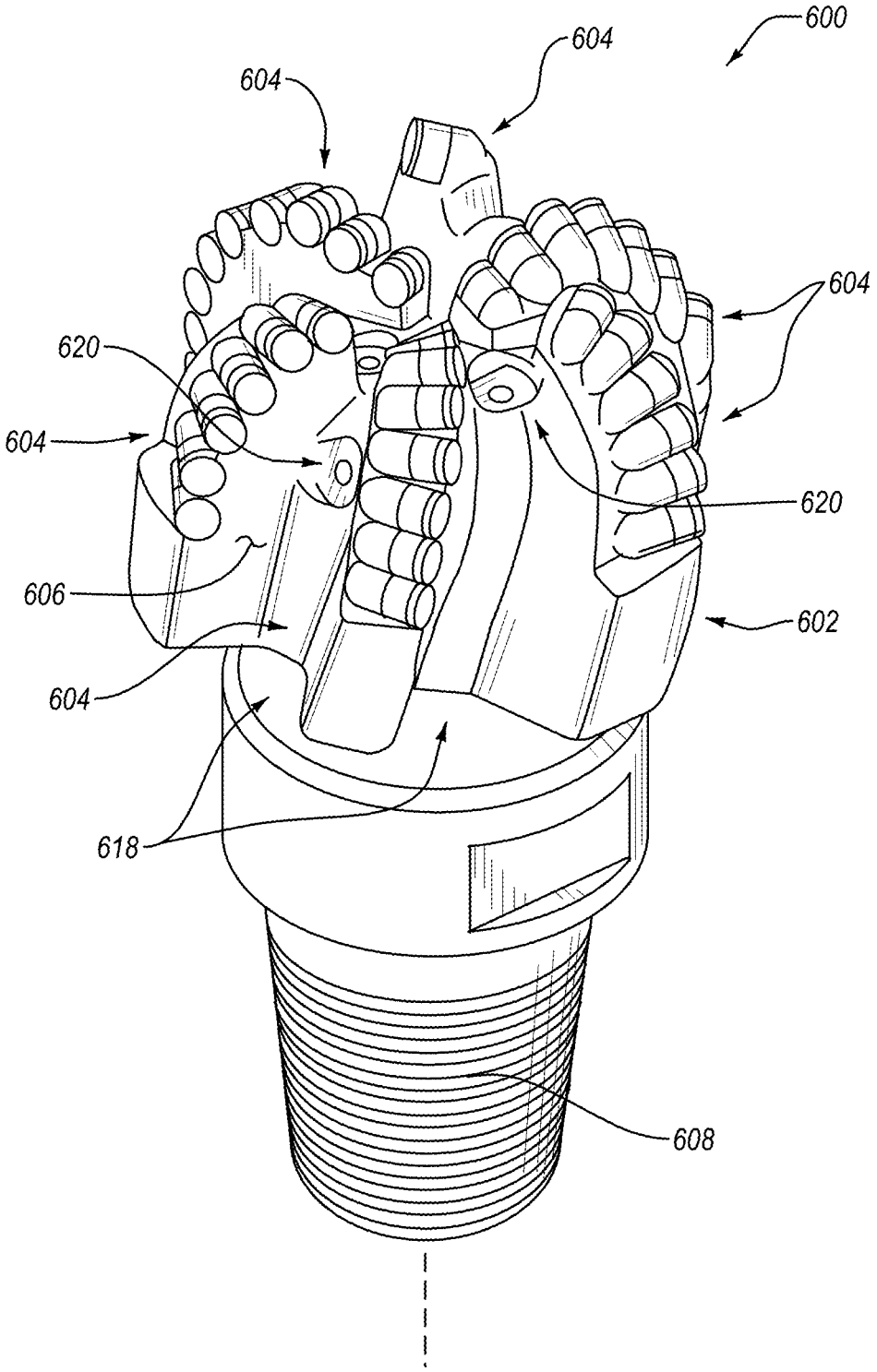
FIG. 6A is an isometric view of an embodiment of a rotary drill bit that may employ one or more of the disclosed PDC embodiments.
Figure 6B:
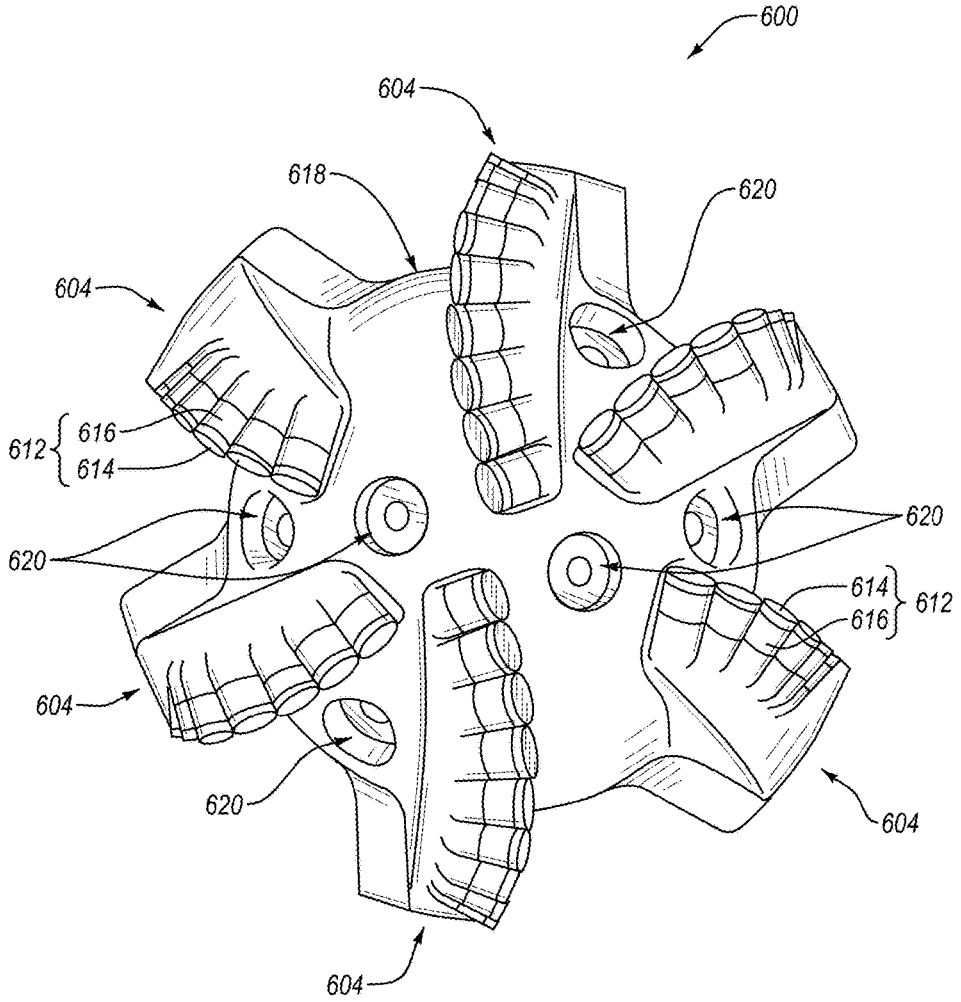
FIG. 6B is a top elevation view of the rotary drill bit shown in FIG. 6A.

FIG. 6A is an isometric view and FIG. 6B is a top elevation view of an embodiment of a rotary drill bit 600. The rotary drill bit 600 includes at least one PDC configured according to any of the previously described PDC embodiments, such as the PDC 100 of FIGS. 1A and 1B. The rotary drill bit 600 includes a bit body 602 that includes radially- and longitudinally-extending blades 604 having leading faces 606 and a threaded pin connection 608 for connecting the bit body 602 to a drilling string. The bit body 602 defines a leading end structure for drilling into a subterranean formation by rotation about a longitudinal axis 610 and application of weight-on-bit. At least one PDC, configured according to any of the previously described PDC embodiments, may be affixed to the bit body 602. With reference to FIG. 6B, each of a plurality of PDCs 612 is secured to the blades 604 of the bit body 602 (FIG. 6A). For example, each PDC 612 may include a PCD table 614 bonded to a cemented carbide substrate 616. More generally, the PDCs 612 may comprise any PDC disclosed herein, without limitation. In addition, if desired, in some embodiments, a number of the PDCs 612 may be conventional in construction. Also, circumferentially adjacent blades 604 define so-called junk slots 620 therebetween. Additionally, the rotary drill bit 600 includes a plurality of nozzle cavities 618 for communicating drilling fluid from the interior of the rotary drill bit 600 to the PDCs 612.

FIGS. 6A and 6B merely depict one embodiment of a rotary drill bit that employs at least one PDC fabricated and structured in accordance with the disclosed embodiments, without limitation. The rotary drill bit 600 is used to represent any number of earth-boring tools or drilling tools, including, for example, core bits, roller-cone bits, fixed-cutter bits, eccentric bits, bicenter bits, reamers, reamer wings, or any other downhole tool including superabrasive compacts, without limitation.

Thus, the embodiments of PDCs disclosed herein may be used on any apparatus or structure in which at least one conventional PDC is typically used. In one embodiment, a rotor and a stator, assembled to form a thrust-bearing apparatus or a radial bearing apparatus, may each include one or more PDCs (e.g., the PDC 100 shown in FIGS. 1A and 1B) configured according to any of the embodiments disclosed herein and may be operably assembled to a downhole drilling assembly. U.S. Pat. Nos. 4,410,054; 4,560,014; 5,364,192; 5,368,398; and 5,480,233, the disclosure of each of which is incorporated herein, in its entirety, by this reference, disclose subterranean drilling systems within which bearing apparatuses utilizing superabrasive compacts disclosed herein may be incorporated. The embodiments of PDCs disclosed herein may also form all or part of heat sinks, wire dies, bearing elements, cutting elements, cutting inserts (e.g., on a roller-cone-type drill bit), machining inserts, or any other article of manufacture as known in the art. Other examples of articles of manufacture that may use any of the PDCs disclosed herein are disclosed in U.S. Pat. Nos. 4,811,801; 4,268,276; 4,468,138; 4,738,322; 4,913,247; 5,016,718; 5,092,687; 5,120,327; 5,135,061; 5,154,245; 5,460,233; 5,544,713; 5,180,022; and 6,793,681, the disclosure of each of which is incorporated herein, in its entirety, by this reference.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

What is claimed is:

1. A polycrystalline diamond compact, comprising:

a polycrystalline diamond table including:

at least one lower region including a plurality of bonded diamond grains exhibiting a lower average grain size; and at least one upper region including a plurality of bonded diamond grains exhibiting an upper average grain size, the lower average grain size of the lower region being at least two times greater than that of the upper average grain size of the at least one upper region; and a cemented carbide substrate including an interfacial surface bonded to the lower region of the polycrystalline diamond table and a cobalt-containing cementing constituent cementing a plurality of tungsten carbide grains together that exhibit an average tungsten carbide grain size of about 0.8 μm to about 1.5 μm, the cemented carbide substrate including a depletion zone that extends inwardly from the interfacial surface to a depth of about 30 μm to about 50 μm, wherein the interfacial surface includes abnormal grain growth over 5% or less of the total surface area thereof.

2. The polycrystalline diamond compact of claim 1 wherein the average tungsten carbide grain size of the plurality of tungsten carbide grains is about 1.2 μm to about 1.4 μm.

3. The polycrystalline diamond compact of claim 1 wherein the lower average grain size of the at least one lower region is at least about 60 μm and the upper average grain size of the at least one upper region is less than about 40 μm.

4. The polycrystalline diamond compact of claim 1 wherein the lower average grain size of the at least one lower region is about 60 μm to about 80 μm and the upper average grain size of the at least one upper region is about 15 μm to about 35 μm.

5. The polycrystalline diamond compact of claim 1 wherein the depletion zone exhibits a depletion zone Palmquist fracture toughness of about 6 $MPa \cdot m^{0.5}$ to about 9 $MPa \cdot m^{0.5}$, and wherein the cemented carbide substrate exhibits a bulk Palmquist fracture toughness away from the depletion zone of about 6 $MPa \cdot m^{0.5}$ to about 12 $MPa \cdot m^{0.5}$.

6. The polycrystalline diamond compact of claim 1 wherein the polycrystalline diamond compact exhibits a greater impact resistance as determined in a drop weight impact test compared to if the cemented carbide substrate exhibited an average tungsten carbide grain size of about 3 μm.

7. The polycrystalline diamond compact of claim 1 wherein the cemented carbide substrate exhibits a greater resistance to liquid metal embrittlement compared to if the cemented carbide substrate exhibited an average tungsten carbide grain size of about 3 μM.

8. The polycrystalline diamond compact of claim 1 wherein the depth of the depletion zone is about 30 μm to about 40 μm.

9. The polycrystalline diamond compact of claim 1 wherein the cobalt-containing cementing constituent is present in the cemented carbide substrate in an amount of about 10 weight % to about 15 weight %.

10. The polycrystalline diamond compact of claim 1 wherein the lower average grain size of the at least one lower region is about 2.5 to about 3.5 times the upper average grain size of the at least one upper region.

11. The polycrystalline diamond compact of claim 1 wherein the cobalt-containing cementing constituent is present in the depletion zone in a concentration that is about 20% to about 40% of a bulk concentration of the cobalt-containing cementing constituent in the cemented carbide substrate outside the depletion zone.

12. The polycrystalline diamond compact of claim 1 wherein the cemented carbide substrate exhibits a transverse rupture strength of about 460 ksi to about 550 ksi.

13. The polycrystalline diamond compact of claim 1 wherein the cemented carbide substrate exhibits a hardness of about 89.0 HRa to about 92 HRa.

14. The polycrystalline diamond compact of claim 1 wherein the plurality of diamond grains in at least a portion of at least one of the at least one upper region or the at least one lower region and the cobalt-containing cementing constituent therein collectively exhibit a coercivity of about 115 Oe or more, and a specific magnetic saturation of about 15 $G \cdot cm^3/g$ or less.

15. The polycrystalline diamond compact of claim 14 wherein the specific magnetic saturation of the at least a portion of at least one of the at least one lower region or the at least one upper region of the polycrystalline diamond table is about 5 $G \cdot cm^3/g$ to about 15 $G \cdot cm^3/g$.

16. The polycrystalline diamond compact of claim 1 wherein the polycrystalline diamond table exhibits a Gratin, as determined by a ratio of the volume of a workpiece cut to the volume of the polycrystalline diamond table worn in a vertical lathe test, of at least about $2 \times 10^6$.

17. The polycrystalline diamond compact of claim 1 wherein the cemented carbide substrate exhibits a first average corrosion pit width when exposed to 10% hydrochloric acid for about 24 hours that is about ⅕ times or less than a second average corrosion pit width of a cemented carbide substrate having an average tungsten carbide grain size of about 3 μm.

18. A rotary drill bit, comprising:

a bit body including a leading end structure configured to facilitate drilling a subterranean formation; and a plurality of cutting elements mounted to the blades, at least one of the plurality of cutting elements including:

a polycrystalline diamond table including:

at least one lower region including a plurality of bonded diamond grains exhibiting a lower average grain size; and at least one upper region including a plurality of bonded diamond grains exhibiting an upper average grain size, the lower average grain size of the at least one lower region being at least two times greater than that of the upper average grain size of the at least one upper region; and a cemented carbide substrate including a cobalt-containing cementing constituent cementing a plurality of tungsten carbide grains together that exhibit an average tungsten carbide grain size of about 0.8 μm to about 1.5 μm, the cemented carbide substrate including an interfacial surface bonded to the lower region of the polycrystalline diamond table and a depletion zone that extends inwardly from the interfacial surface to a depth of about 30 μm to about 60 μm, wherein the interfacial surface includes abnormal grain growth over 5% or less of the total surface area thereof.

19. The polycrystalline diamond compact of claim 1 wherein the upper average grain size of the upper region is greater than about 20 μm.

20. The polycrystalline diamond compact of claim 1 wherein the cemented carbide substrate includes a single cemented carbide substrate.

21. The polycrystalline diamond compact of claim 1 wherein a thickness of the at least one upper region measured from an upper surface of the polycrystalline diamond table to a boundary between the at least one lower region and the at least one upper region varies.

22. The polycrystalline diamond compact of claim 21 wherein the boundary between the at least one lower region and the at least one upper region is curved.

* * * * *